US006076512A

United States Patent [19]

Thielen et al.

[11] Patent Number: 6,076,512

[45] Date of Patent: Jun. 20, 2000

[54] SYNCHRONIZED LIMB ARCHERY BOW

[76] Inventors: Joseph M. Thielen, 3027 Cameron Ave. SE., Buffalo, Minn. 55313; William J. Drasler, 4100 Dynasty Dr., Minnetonka, Minn. 55345

[21] Appl. No.: 09/189,248

[22] Filed: Nov. 10, 1998

[51] Int. Cl.[7] ..... F41B 5/10

[52] U.S. Cl. ..... 124/25.6

[58] Field of Search ..... 124/23.1, 25.6, 124/86, 900

[56] References Cited

U.S. PATENT DOCUMENTS

| | | | |
|---|---|---|---|
| 3,486,495 | 12/1969 | Allen | 124/25.6 |
| 3,854,467 | 12/1974 | Hofmeister | 124/25.6 |
| 3,923,035 | 12/1975 | Trotter | 124/25.6 |
| 3,987,777 | 10/1976 | Darlington | 124/25.6 |
| 4,060,066 | 11/1977 | Kudlacek | 124/25.6 |
| 4,365,611 | 12/1982 | Nishioka | 124/25.6 |
| 4,562,824 | 1/1986 | Jennings | 124/25.6 |
| 4,683,865 | 8/1987 | Troncoso | 124/25.6 |
| 4,971,020 | 11/1990 | Soderstrom et al. | 124/25.6 X |
| 5,353,777 | 10/1994 | Fincher | 124/25.6 X |
| 5,368,006 | 11/1994 | McPherson | 124/25.6 |
| 5,388,564 | 2/1995 | Islas | 124/25.6 |
| 5,505,185 | 4/1996 | Millar | 124/25.6 |
| 5,535,727 | 7/1996 | Helmuth | 124/25.6 |

*Primary Examiner*—John A. Ricci

[57] ABSTRACT

An improvement to a compound archery bow with cam pulleys positioned on upper and lower flexible limbs, the improvement involving a synchronizing pulley mechanism attached to a handle-riser. A draw string interfaces with each of the cam pulleys. An upper and lower power string interface with each cam pulley and interface with the synchronizing pulley mechanism. Upper and lower limb strings interface with the synchronizing pulley mechanism and attach to the upper and lower flexible limbs causing the flexible limbs to be coupled to each other such that each limb moves the same amount of deflection during the draw of the draw string and during launching of an arrow. Variations in limb flexibility from one limb to the other will not affect the amount of limb deflection. Movement of a nocking point of the draw string will be on a straight line parallel to the centerline of the archery bow during arrow launch.

31 Claims, 17 Drawing Sheets

SYNCHRONIZED LIMB ARCHERY BOW

BACKGROUND OF THE INVENTION

1. Field of Invention

The present invention relates to an archery bow, and more particularly to a compound bow with a synchronizing pulley mechanism that couples each of two flexible limbs such that they are required to flex the same amount providing the bow with a straight line movement of the nocking point for increased accuracy.

2. Description of Prior Art

Compound bows allow the archer to draw the draw string with an increasing draw weight until a peak draw weight is attained and thereafter the draw weight drops off to a minimum draw weight referred to as a let-off of draw weight. The force-draw curve for a compound bow allows the archer to store a maximum amount of energy during the draw of the draw string and hold the draw string in a full drawn position for an extended period of time at a low draw force. To obtain a favorable force-draw curve and let-off found in compound bows typically a cam-shaped pulley such as an eccentric pulley is mounted at the end of each bow limb to provide the draw string with a lever arm that is greatest in the full drawn position. The cam-shaped pulleys also require synchronization with each other such that the lever arm that they offer to the draw string is the same throughout the launch period for each of the bow limb mounted cam-shaped. pulleys. Failure to properly synchronize the cam-shaped pulleys results in nonlinear movement of the nocking point of the draw string during arrow launch resulting in inaccuracy.

U.S. Pat. No. 3,486,495 issued to Allen describes a compound bow with a single cam-shaped pulley attached to each flexible limb. A draw string passes around each of the cam-shaped pulleys and extends to the opposite limb for attachment. Any variation in limb flexibility from one limb to the other will result in a nonlinear path for the nocking point of the draw string. Each cam must be synchronized with the other to approach a straight line motion for the nocking point.

Another approach for a compound bow is described by Kudlacek in U.S. Pat. No. 4,060,066. Kudlacek places a cam pulley means at the distal end of each flexible limb. Each cam pulley means consists of two cam-shaped pulleys, one that provides for take-up and pay-out of the draw string and the other for take-up and pay-out of a power string that extends to the opposite flexible limb for attachment. This design offers an archery bow with an excellent force-draw curve but does not address movement of the nocking point due to variations in limb flexibility. The bow designs described by Kudlacek require that the cam-shaped pulleys be synchronized between the top and bottom limbs in order to reduce any additional nocking point movement due to maladjustment of the pulleys.

Jennings describes in U.S. Pat. No. 4,562,824 a bow that has a cam pulley means attached directly to the handle-riser to provide a let-off of draw force to the draw string at full draw. Attached to each of the flexible limbs are round idler pulleys that provide passage for the draw string to the cam pulley means. The cam pulley means consists of four cam pulleys that are attached together and rotate about a single axis. Since the pulleys are attached, they cannot fall out of synchronization and hence this bow overcomes the synchronization problem associated with having a cam pulley means located on each of the flexible limbs. Rotation of the four cam pulleys in the same direction during arrow launch creates an imbalanced torque on the bow that causes movement of the bow and resulting inaccuracy.

In U.S. Pat. No. 5,368,006 McPherson describes a bow with a cam pulley means attached to only one flexible limb of the bow; the other flexible limb has a round idler pulley attached. The pulley means is made up of three cam-shaped pulleys that are rotationally attached together and provide for a let-off of draw force at full draw. Although this bow overcomes the problems associated with synchronization of cams mounted on each of two limbs, it does not address nonlinear nocking point movement due to variations in limb flexibility between the two limbs.

Miller discloses in U.S. Pat. No. 5,505,185 a bow that is similar to that described by McPherson above except that he attaches two cam pulleys to the top flexible limb and three cam pulleys to the bottom flexible limb. This bow is designed to keep the nocking point in the center between the two pivot points for the two cam pulley means. This bow does not, however, keep the nocking point on a constant line with the arrow rest located on the handle-riser. Variations in flexibility of each limb will also result in movement of the nocking point in a nonlinear manner.

Helmuth describes a rigid limb bow with flexible limb springs in U.S. Pat. No. 5,535,727. This bow has two sets of cam pulleys which are attached to the rigid limbs and are coupled together to provide linear movement of the nocking point. Two additional flexible limbs have round idler pulleys attached which provide passage for power cam cables. The draw string does not directly interface with the flexible limbs and the angle of the draw string to each of the cam pulleys positioned on the rigid arms at full draw is too sharp for practical application.

Nishioka describes in U.S. Pat. No. 4,365,611 a bow with one rigid arm and one flexible arm. The lower flexible limb has a lower pulley means attached which consists of two concentric pulleys and an eccentric pulley rotatingly fixed together. The upper rigid limb has two rotatingly joined pulleys attached. A flexible link cable is used to interface with the lower pulley means and interface with an eccentric pulley attached to the handle-riser. This bow will control nocking movement in a linear direction provided that the rigid limb does not flex. Inertial effects associated with the return of the flexible limb back to a resting position during arrow launch will cause unwanted movement of this bow and reduced accuracy.

Several other bows have been described by Hofmeister (U.S. Pat. No. 3,854,467), Trotter (U.S. Pat. No. 3,923,035), and Darlington (U.S. Pat. No. 3,987,777) that comprise cam pulley means attached to the handle-riser and round concentric pulleys positioned at the ends of each flexible limb. Hofmeister, Trotter, and Darlington have each described a cam pulley means consisting of two cam pulleys that are coupled together and would require synchronization to ensure linear nocking point movement. Let-off of draw force is provided by the cam pulley means attached to the handle-riser. The cam pulley means could not be applied to a compound bow with cam pulleys located on the flexible limbs.

Problems with nonlinear nocking point movement will result in an inaccurate arrow launch. This problem is found in compound bows with flexible limbs and more specifically in compound bows that have a cam pulley means located on each of the flexible limbs. Several prior art patents have attempted to reduce the amount of nocking point movement by combining the two cams into a single cam or by moving the cam pulley means to the handle-riser. Maintaining the two cams on each of the two flexible limbs bears the advantage that the rotational torque of the two cams balances each other. No prior art disclosure describes a suitable device for synchronizing bow limb movement such that variations in limb flexibility for a bow with cams positioned on the limbs will not result in nocking point movement.

SUMMARY OF THE INVENTION

Limb Synchronizing Mechanism Application

The present invention overcomes the disadvantages of prior art compound archery bows with cam pulleys or eccentric pulleys located at the distal ends of their flexible limbs. Such bows experience nocking point movement during arrow launch due to variations in flexibility between the two flexible limbs. The present invention is a limb synchronizing mechanism that attaches to the handle-riser and serves to couple each flexible limb together such that each limb moves the same amount during the draw of the draw string and during the launch of the arrow. Any variation in limb flexibility will not result in nonlinear movement of the nocking point of the draw string during arrow launch. The arrow is therefore launched on a straight line with enhanced accuracy over standard prior art compound bows with cam pulleys positioned on the flexible limbs.

A standard compound bow with flexible limbs and with limb cam pulleys will experience a vertical movement of the limbs if a vertical force is applied to the upper or lower limb while holding onto the handle-riser such that it is fixed in space. The limb synchronizing mechanism of the present invention prevents such movement for small forces that are found due to imbalanced limbs. Only for such imbalanced or external forces that are greater than approximately fifty percent of the forces applied by the limbs onto the drawstring does limb movement for one simulated example of the present invention actually occur. The diameter of the limb synchronizing mechanism of the present invention can be adjusted such that for external or imbalanced forces ranging from one to one hundred percent of the forces applied by the limbs onto the drawstring, movement of the flexible limbs will result. Therefore the limbs of the bow of the present invention equipped with a synchronizing mechanism can have considerable variation in their limb flexibility without observing any nonlinear movement of the nocking point during a typical arrow launch. The addition of the limb synchronizing mechanism to a compound bow with cam pulleys on the limbs produces a bow with increased accuracy. The limb synchronizing mechanism can be added onto existing compound bows with limb cam pulleys allowing such bows to be converted into a more accurate bow regardless of variations in limb flexibility. Such standard compound bows have upper and lower cam pulleys that provide passage for the upper and lower end of a draw string and the cam pulleys are often attached to the draw string. Typically the top power string is also provided passage by an upper cam pulley and can extend to the lower flexible limb or the upper flexible limb where it can be attached. Such a string that is attached to the top limb for the purpose of holding the top limb at least in part in its flexed condition is termed a top limb string. The top power string can be the same contiguous string as a top or bottom limb string. Similarly a bottom power string which has passage along a lower cam pulley can extend to the upper flexible limb or can extend back to the lower flexible limb where it can be attached. The bottom power string can be the same contiguous string as the top or bottom limb string.

The limb synchronizing mechanism of the present invention produces a new bow with unique qualities not found in standard prior art compound bows with limb cam pulleys. The moment of inertia created by rotating circular pulleys found in the limb synchronizing mechanism is small and does not contribute to torque imposed upon the archery bow during arrow launch.

Operational Procedure

As the draw string of a standard compound bow with limb cam pulleys is drawn back to a full drawn position, the cam pulleys rotate to provide let-off of draw force. These cam pulleys must be positioned equally as mirror images of each other with respect to the bow centerline or synchronized in order to provide the nocking point of the draw string with a linear movement. In addition to this, variations in flexibility of the limbs can also contribute to a nonlinear nocking point movement. If one limb is more flexible than the other limb, then the more flexible limb will move a greater distance during the draw of the draw string. This causes the nocking point to shift away from the centerline of the bow resulting in loss of accuracy for the launched arrow.

The limb synchronization mechanism of this invention requires that each flexible limb of a compound bow with limb cam pulleys move the same amount regardless of variations in their flexibility. As the draw string of the present archery bow invention is drawn back, each cam pulley is caused to take-up a power string that causes rotation of circular pulleys within a synchronizing pulley mechanism. The synchronizing pulley mechanism is coupled to each flexible limb with a limb string causing each limb to move a similar amount. The amount of movement is independent of small variations in limb flexibility normally found in standard compound bows.

Initial set-up of the archery bow strings and tuning of the bow of the present invention provides additional advantages over prior art compound bows. With the present bow the bow limbs are first compressed in order to set the cam pulley position on each cam pulley. Next the power strings are adjusted along with the limb synchronizing pulley mechanism. Once the limbs are decompressed, no further adjustment is necessary. With standard compound bows movement often occurs upon bow decompression and further adjustment of the limb cam pulley position is required due to movement associated with differences in limb flexibility.

Structure of the Limb Synchronizing Bow

In the first embodiment of the present invention a compound archery bow with cam pulleys or eccentric pulleys positioned on each flexible limb is fitted with a synchronizing pulley mechanism mounted to the handle-riser. The synchronizing pulley mechanism comprises a concentric pulley that provides passage for take-up and pay-out of two power strings, one that has passage along each limb pulley and can be attached to the limb pulley, and two limb strings, one that attaches to each limb. The synchronizing pulley controls the pay-out of limb string to each of the flexible limbs on an equal amount thereby requiring them to move an equal amount independent of their flexibility. Since the synchronizing pulley is concentric, it can be structured with a smaller diameter and made of a smaller mass than a cam-shaped pulley. Therefore the torque produced by rotation of the synchronizing pulley is negligible and does not affect the stability of the bow during arrow launch.

In the second embodiment of the present invention a synchronizing pulley mechanism containing two concentric synchronizing pulleys is attached to the handler-riser. One synchronizing pulley provides interface for two limb strings and the other provides for interface of two power strings. The two power strings and two limb strings attach at a common junction point located between the two concentric synchronizing pulleys. Each flexible limb is thereby controlled such that each limb is required to move an equal amount. The synchronizing pulleys of this embodiment are round idler pulleys that can be very small in diameter thereby obviating any significant contribution they may have on inertial moments.

The third embodiment of the present invention describes a synchronizing pulley mechanism comprising two concentric or round pulleys mounted to the handle-riser. Two power strings that pass along limb cam pulleys and can be attached to the limb cam pulleys and two limb strings that attach to each flexible limb interface with these two concentric pulleys. In addition the two synchronizing pulleys provide interface for a coupling string that couples the rotation of the two pulleys in the opposite direction. Movement of the draw string requires that each flexible limb move the same amount regardless of differences in limb flexibility. Torque associated with the two synchronizing pulleys is effectively cancelled due to their opposed direction. All three embodiments produce the same overall effect. They force each flexible limb of a compound bow to flex the same amount during the draw of the draw string regardless of variations in limb flexibility.

Operation of the Synchronizing Bow

The operation of the synchronizing bow of this invention is similar to other compound bows with cam or eccentric pulleys attached to their flexible limbs. Let-off of force is provided by the two cam pulleys located at the end of each flexible limb. As the draw string is pulled back to a full draw, the synchronizing pulley mechanism requires that each flexible limb flex an equal amount even if the limbs are of different flexibility. The nocking point of the draw string moves in a straight line that is in line with the centerline of the archery bow. This ensures that the arrow will be launched with the greatest opportunity for accuracy.

Other configurations for the synchronizing pulley mechanism can also be successfully employed in the bow of this invention to provide straight line movement for the nocking point of a compound archery bow with limb cam pulleys. The present invention teaches the use of concentric or round pulleys that are attached to the handler-riser of a compound bow for the purpose of coupling the movement of two flexible limbs. This coupling ensures that the two limbs move a similar amount during bow flexing and arrow launch regardless of differences in the flexibility of the two limbs. These other bow configurations are intended to be included in the overall teachings of the present invention.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1A:
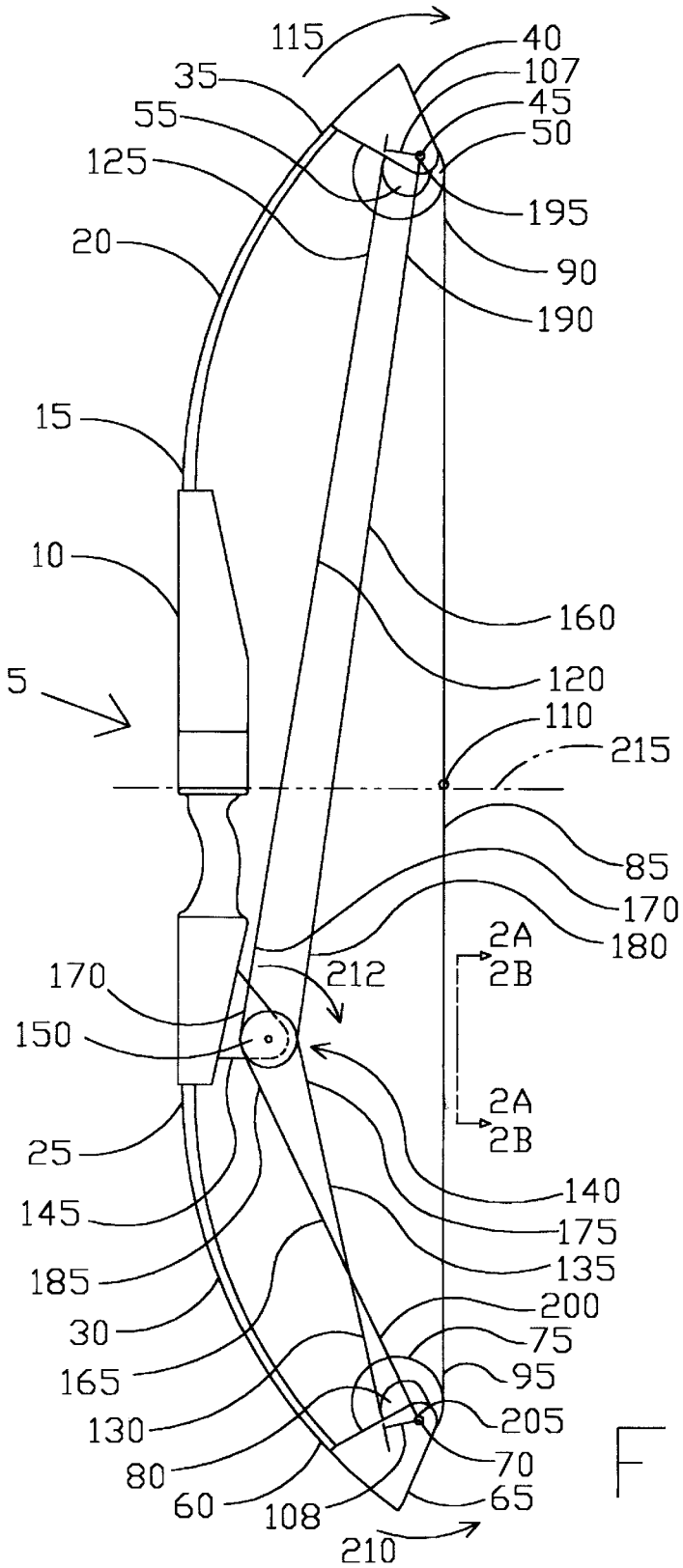
FIG. 1A is a plan view of the primary embodiment of the synchronized limb archery bow of this invention in a resting position.

FIG. 1A is a plan view of the primary embodiment of the synchronized limb archery bow 5 of this invention. A handle-riser 10 is attached to a proximal end 15 of the upper flexible limb 20 and a proximal end 25 of a lower flexible limb 30. A distal end 35 of the upper flexible limb 20 has an upper limb pulley clevis 40 attached. An upper clevis axle 45 provides rotational support for an upper draw string cam pulley 50 and an upper power string cam pulley 55. A distal end 60 of the lower flexible limb 30 has a lower limb pulley clevis 65 attached. A lower clevis axle 70 provides rotational support for a lower draw string cam pulley 75 and a lower power string cam pulley 80. The upper draw string cam pulley 50 and the upper power string cam pulley 55 can be replaced by a single cam pulley, multiple cam pulleys, eccentric round pulleys, or other cam-shaped pulley means that provides for a let-off of force during the draw of the synchronized limb archery bow 5. Similarly the cam pulleys positioned on the lower flexible limb 30 can be replaced in a manner similar to that of the upper flexible limb 20. The upper and lower flexible limbs 20 & 30 can provide other means of attachment for an upper or lower pulley means other than the upper or lower limb pulley clevis. For example, the upper and lower flexible limbs can be split limbs (not shown) with an upper or lower pulley means mounted directly to the upper and lower flexible limbs 20 & 30, respectively.

Figure 1B:
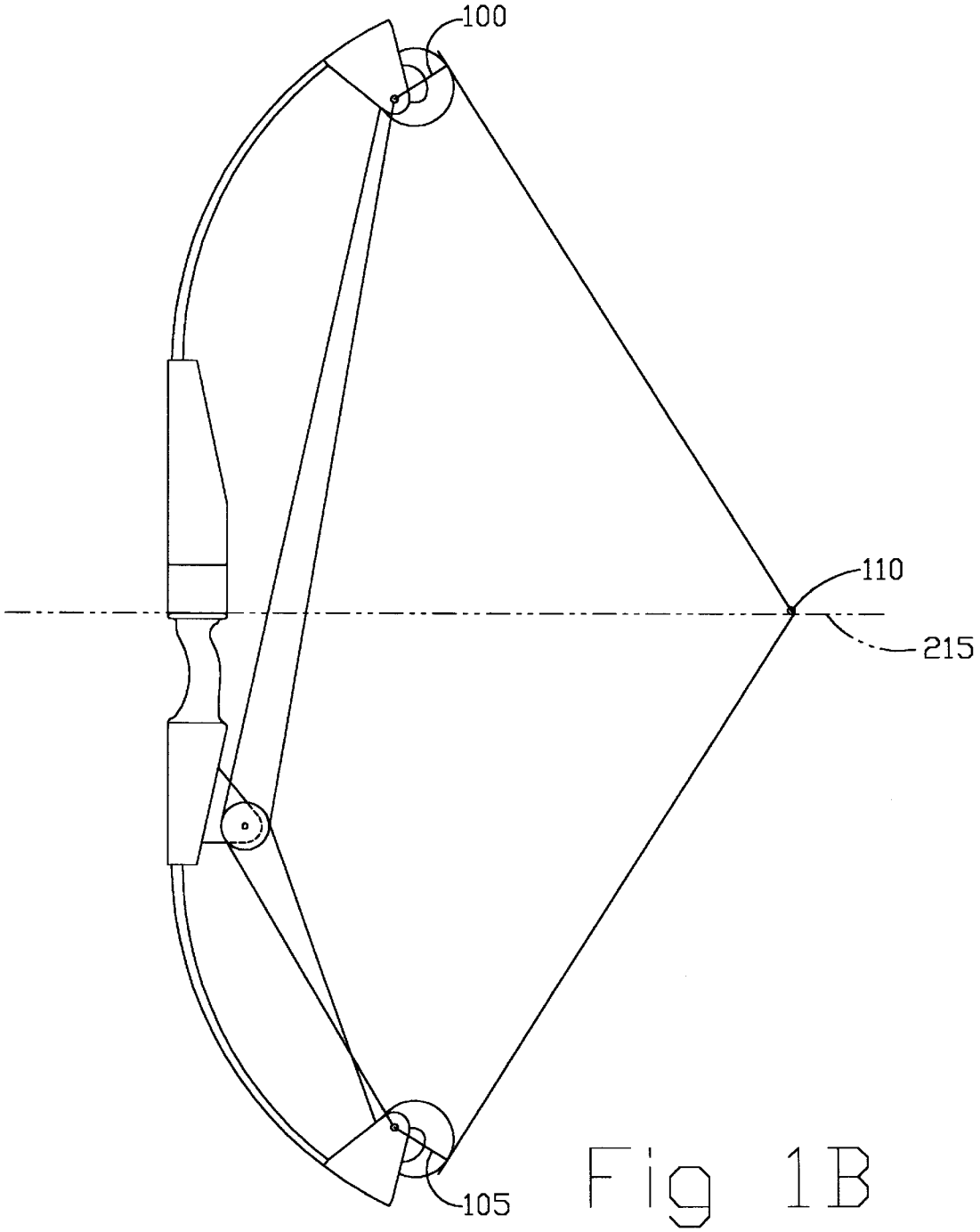
FIG. 1B is a plan view of the primary embodiment of the synchronized limb archery bow of this invention in a full drawn position.

A draw string 85 extends from the upper draw string cam pulley 50 to the lower draw string cam pulley 75. The upper end 90 of the draw string 85 has passage along the upper draw string cam pulley 50 without slippage or is attached thereto and therefore has non-slip passage with the upper draw string cam pulley 50. The lower end 95 of the draw string 85 has passage along the lower draw string cam pulley 75 without slippage or is attached to it. The upper and lower draw string cam pulleys 50 & 75 are rotationally positioned such that an upper draw string lever arm 100 (shown in FIG. 1B) provided from the draw string 85 to the upper clevis axle 45 is equal to a lower draw string lever arm 105 (shown in FIG. 1B) provided from the draw string 85 to the lower clevis axle 70. Similarly the upper power string lever arm 107 is set equal to the lower power string lever arm 108. As the draw string 85 is drawn back to a full drawn position (shown in FIG. 1B) with an arrow (not shown) attached at a nocking point 110, the upper and lower draw string cam pulleys 50 & 75 rotate to pay out draw string 85 and provide an increased lever arm 100 & 105 to the draw string 85 such that the draw string 85 can be held at a lower force than the average draw force. This reduced holding force is referred to as a let-off of draw force. The cam-shaped upper and lower draw string cam pulleys 50 & 75 also provide the bow 5 with a force-draw curve that allows for optimal storage of energy associated with drawing the draw string 85 to a full drawn position as shown in FIG. 1B.

Rotation of the upper draw string cam pulley 50 in a clockwise direction 115 during draw of the draw string 85 causes the upper power string cam pulley 55 to rotate in a clockwise direction 115 and cause take-up of top power string 120 which has passage along the upper power string cam pulley 55 and can be attached thereto. The upper end 125 of the top power string 120 passes along the upper power string cam pulley 55 without slippage or is attached thereto. The upper end 125 of the top power string 120 is therefore understood to have non-slip passage with the upper power string cam pulley 55. The upper power string cam pulley 55 also contributes to the let-off of draw force and contributes to an optimal force-draw curve found in compound archery bows with cam pulleys positioned on their flexible limbs. The lower end 130 of the bottom power string 135 similarly has non-slip passage with the lower power string cam pulley 80 and performs a similar function to the upper end 125 of the top power string 120 and the upper power string cam pulley 55. The upper power string cam pulley 55 can be combined with the upper draw string cam pulley 50 to form a single upper cam pulley and similar modifications can be made to form a single lower cam pulley. Additional cam-shaped pulleys can be added to the upper flexible limb or the lower flexible limb without changing the scope of the present invention. Attached to the handle-riser 10 is a synchronizing pulley mechanism 140 consisting of a synchronizing pulley mechanism clevis 145 and a synchronizing pulley means 150 which comprises one or more pulleys. In the primary embodiment, the synchronizing pulley means 150 contains a single synchronizing pulley 155 (see FIG. 2A) that has four individual passages for four strings. The synchronizing pulley means could contain a two passage synchronizing pulley or other types of synchronizing pulleys, some of which are described in alternate embodiments. The synchronizing pulley means 150 could also have a single common passage which could be shared by all strings that interface with it. The four passage synchronizing pulley 155 provides passage for a top limb string 160 which is attached to the upper flexible limb 20, a top power string 120, a bottom power string 135, and a bottom limb string 165 which is attached to the lower flexible limb 30. It is this synchronizing pulley mechanism 140 that controls the movement of each of the flexible limbs 20 & 30 such that they move the same amount during arrow launch. In a standard compound bow the top power string 120 can extend to the lower flexible limb 30 and be contiguous with the bottom limb string 165. Similarly, in a standard compound bow the bottom power string 135 can extend to the upper flexible limb 20 and be contiguous with the top limb string 160.

A synchronizing pulley or groups of synchronizing pulleys that comprise the synchronizing pulley means 150 taught by this invention are all axisymmetric or round. They are not designed to provide the archery bow 5 of this invention with let-off of draw force; the let-off of force is provided by cam-shaped pulleys 50, 55, 75, & 80 located at the distal ends of the flexible limbs 35 & 60. The axisymmetric shape for the synchronizing pulley or pulleys found in the synchronizing pulley means 150 allows them to attain a smaller diameter and a lower mass than that of a complex shaped cam pulley. This provides the synchronizing pulley means 150 of the present invention with a low moment of inertia and hence will not contribute a significant torque to the archery bow 5 during arrow launch. Although the individual passages for the preferred embodiment of the present invention are of the same diameter as shown later in FIG. 2A, it is understood and presently stated that the diameter for an individual passage or for more than one passage can be of a different diameter than another passage as will be shown in FIG. 1C.

The lower end 170 of the top power string 120 interfaces with the four passage synchronizing pulley 155. The top power string 120 interfaces with the synchronizing pulley 155 is a non-slip passage along one of the four passages 172*a*, 172*b*, 172*c*, & 172*d* (FIG. 2A) of the synchronizing pulley 155. Interface can also be a passage and attachment of the top power string 120 along one of the four passages of the synchronizing pulley 155. In a manner similar to top power string 120, the upper end 175 of the bottom power string 135 interfaces with another passage 172*a*, 172*b*, 172*c*, & 172*d* of the four passage synchronizing pulley 155.

The lower end 180 of the top limb string 160 interfaces with the four passage synchronizing pulley 155. The top limb string 160 interfaces with the synchronizing pulley 155 is a non-slip passage along one of the four passages 172*a*, 172*b*, 172*c*, & 172*d* (FIG. 2A) of the synchronizing pulley 155. The top limb string could also interface with the synchronizing means by passing along and attaching to one of the four passages of the synchronizing pulley 155. Similarly, the upper end 185 of the bottom limb string 165 interfaces with another passage 172*a*, 172*b*, 172*c*, & 172*d* of the four passage synchronizing pulley 155. Interface of the limb or power strings 120, 135, 160, or 165 with the synchronizing pulley 155 requires passage of the limb or power string along the synchronizing pulley 155 and a resultant coupling of the upper 20 and lower 30 flexible limbs such that they are required to flex an equal amount during the draw of the draw string 85. This coupling can occur if the limb and power strings 120, 135, 160, and 165 are attached to each other as shown later in an alternate embodiment. The upper end 190 of the top limb string 160 is attached to the top limb string attachment site 195. The top limb string attachment site 195 can be located at another suitable location on the upper flexible limb 20. The lower end 200 of the bottom limb string 165 is attached to the bottom limb string attachment site 205. The top or bottom limb string attachment sites 195 & 205 can be any sites that allow for attachment of the top and bottom limb strings 160 & 165, respectively, on the distal ends 35 & 60 of the upper 20 and lower 30 flexible limbs. The possible means for interface of the top and bottom power strings 120 & 135 and top and bottom limb strings 160 & 165 with the four passage synchronizing pulley are described further in FIGS. 4–8.

Rotation of the upper power string cam pulley 55 in a clockwise direction 115 and of the lower power string cam pulley 80 in a counterclockwise direction 210 during the draw of the draw string 85 causes the top power string 120 and bottom power string 135 to rotate the four passage synchronizing pulley 155 in a clockwise direction 212. This four passage synchronizing pulley 155 rotation causes take-up of the top limb string 160 and the bottom limb string 165 by the synchronizing pulley 155 at an equal amount. The top limb string 160 and the bottom limb string 165 pull on the upper flexible limb 20 and the lower flexible limb 30, respectively, to cause them to flex an equal amount. The nocking point 110 of the draw string 85 is then required to move in a linear direction parallel to the centerline 215 of the archery bow 5.

As shown in FIG. 1A, the bottom limb string 165 follows a path that crosses with the bottom power string 135 and the top limb string 160 follows a path that does not cross the top power string 120. It is understood that these four strings could have been routed such that the top strings crossed over each other and the bottom strings did not cross. Furthermore, it is understood that these four strings, the top and bottom limb strings 160 & 165, and the top and bottom power strings 120 & 135, have been given specific reference names and numbers for clarity purposes but do not have to be four individual strings. For example, the top power string 120 can be the same integral and contiguous string as the top limb string 160, or the bottom power string 135, or the bottom limb string. This will be explained further in FIGS. 4–9.

Figure 1C:
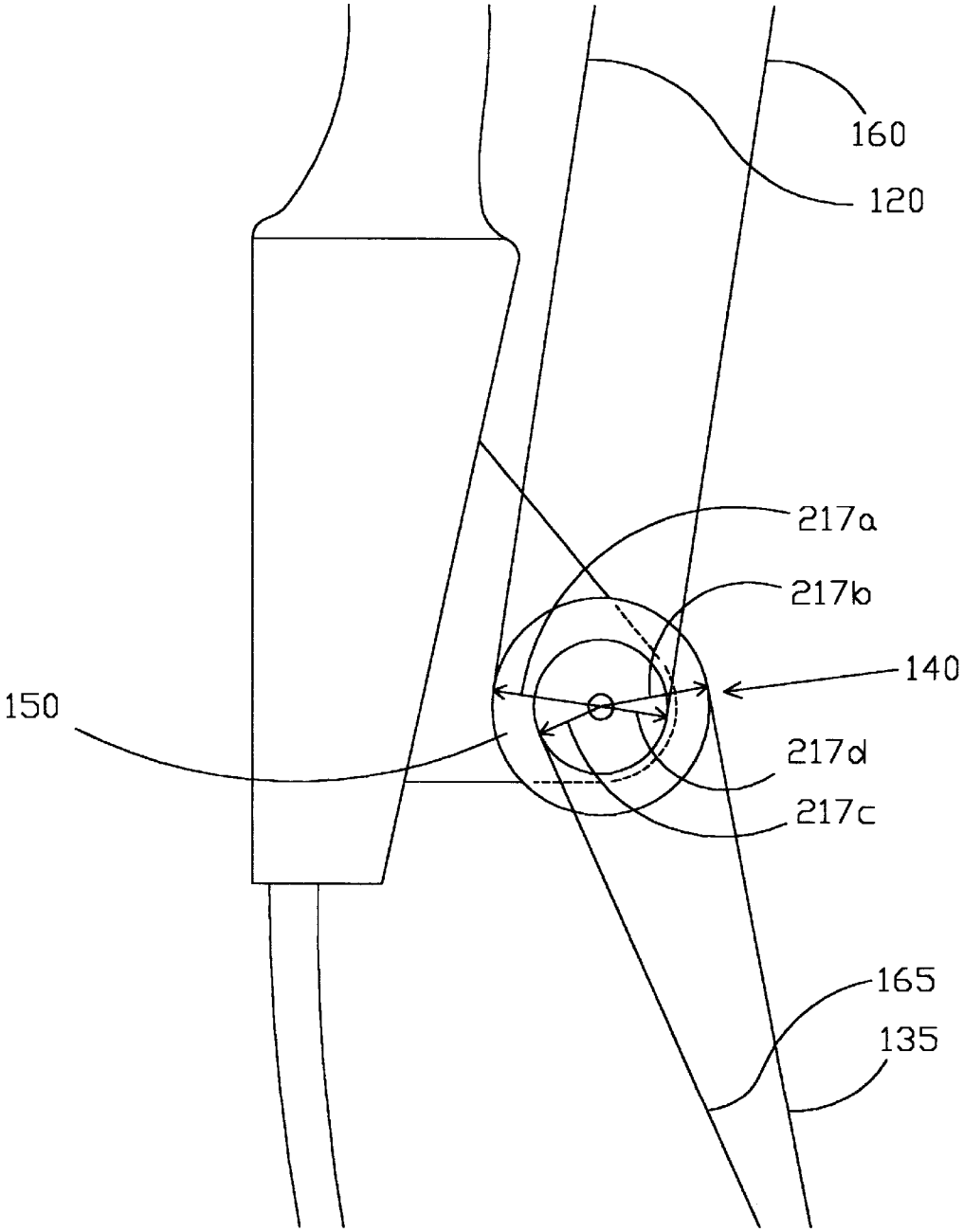
FIG. 1C is a plan view of a synchronizing pulley mechanism.

FIG. 1C is plan view of the synchronizing pulley mechanism 140 with a synchronizing pulley means 150. For explanatory purposes the synchronizing pulley means 150 will be described using the four passage synchronizing pulley shown in FIG. 2A. The top 120 and bottom 135 power strings interface with two passages of the four passage synchronizing pulley 155 at a diameter that is greater than the diameter of the two passages interfaced by the top 160 and bottom 165 limb strings. The power strings 120 & 135 are therefore shown with greater diametrical lever arms 217*a* & 217*b* than the diametrical lever arms 217*c* & 217*d* of the limb strings 160 & 165. During the draw of the draw string 85, pay-out of the top 120 and bottom 135 power strings by the synchronizing pulley 155 produces a smaller take-up of the top 160 and bottom 165 limb strings. This synchronizing pulley means, exemplified by the synchronizing pulley mechanism 140 just described, is well suited to an archery bow with limbs that are relatively more stiff. The flexibility of the limbs that are suitable for use with the synchronizing pulley mechanism 140 could range from rather stiff to extremely flexible depending upon the ratios of diameters of pulleys used in the synchronizing pulley means 150 and the diametrical lever arms 217*a*, 217*b*, 217*c*, & 217*d* provided by the synchronizing pulley means 150. An archery bow with very flexible limbs could provide passage of the top 160 and bottom 165 limb strings on a larger diameter passage of the synchronizing pulley 155 than that providing passage for the top 120 and bottom 135 power strings.

Figure 2A:
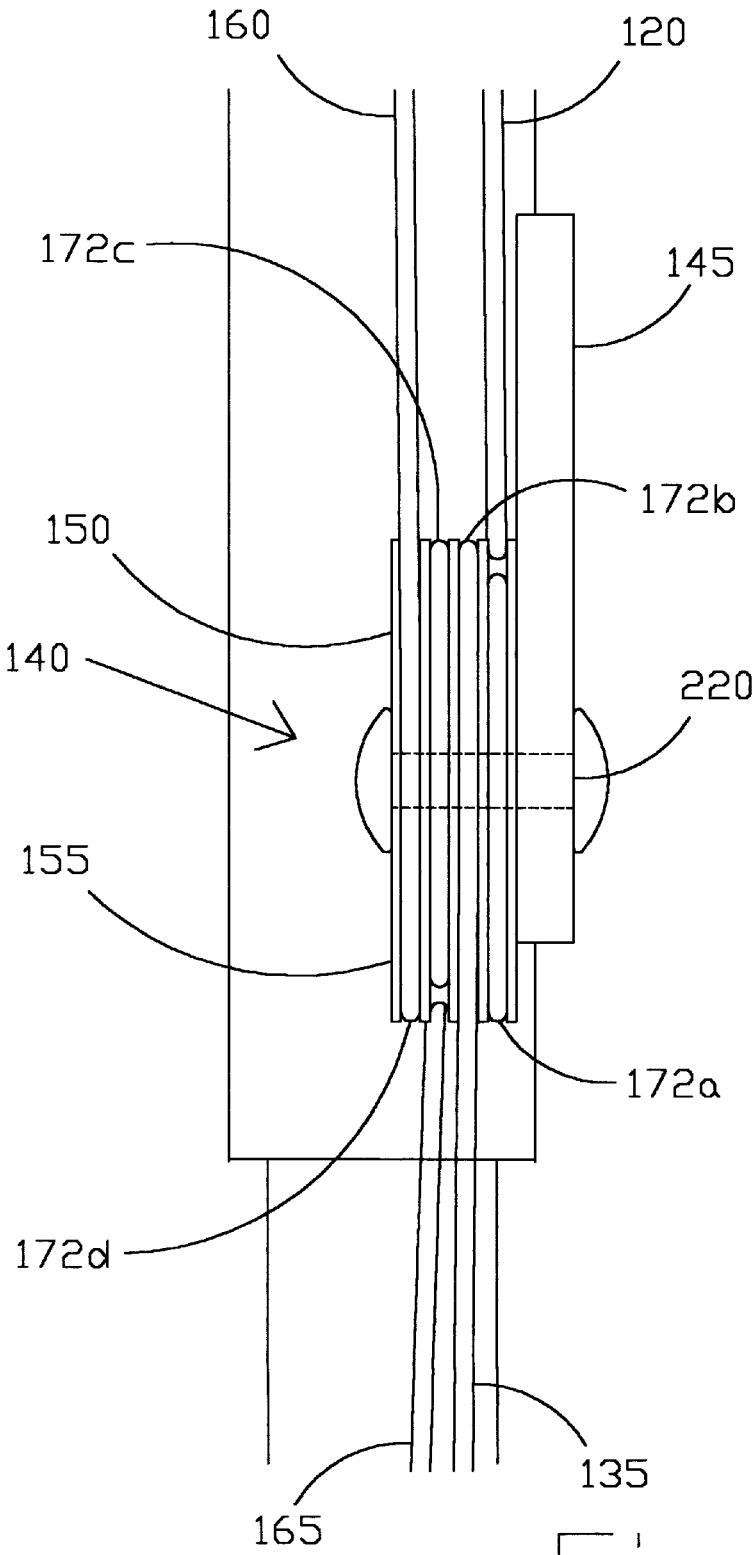
FIG. 2A is a partially sectioned view of a synchronizing pulley mechanism with a four passage synchronizing pulley.

FIG. 2A is a partially sectioned view of the synchronizing pulley mechanism 140 shown in FIG. 1A. A synchronizing pulley clevis 145 holds a synchronizing pulley axle 220 that provides rotational support for the four passage synchronizing pulley 155 about its axis. The diameter of the four passage synchronizing pulley 155 is small in comparison to most cam pulleys found on the end of an upper or lower flexible limb of a standard compound archery bow. The top 160 and bottom 165 limb strings and the top 120 and bottom 135 power strings each are provided with a separate passage 172*a*, 172*b*, 172*c*, & 172*d* and each string 120, 135, 160, & 165 can wrap around its individual passage for greater than 180 degrees of travel. This allows the four passage synchronizing pulley 155 to have only a small moment of inertia and will not transmit an undesirable torque to the archery bow during arrow launch.

Figure 2B:
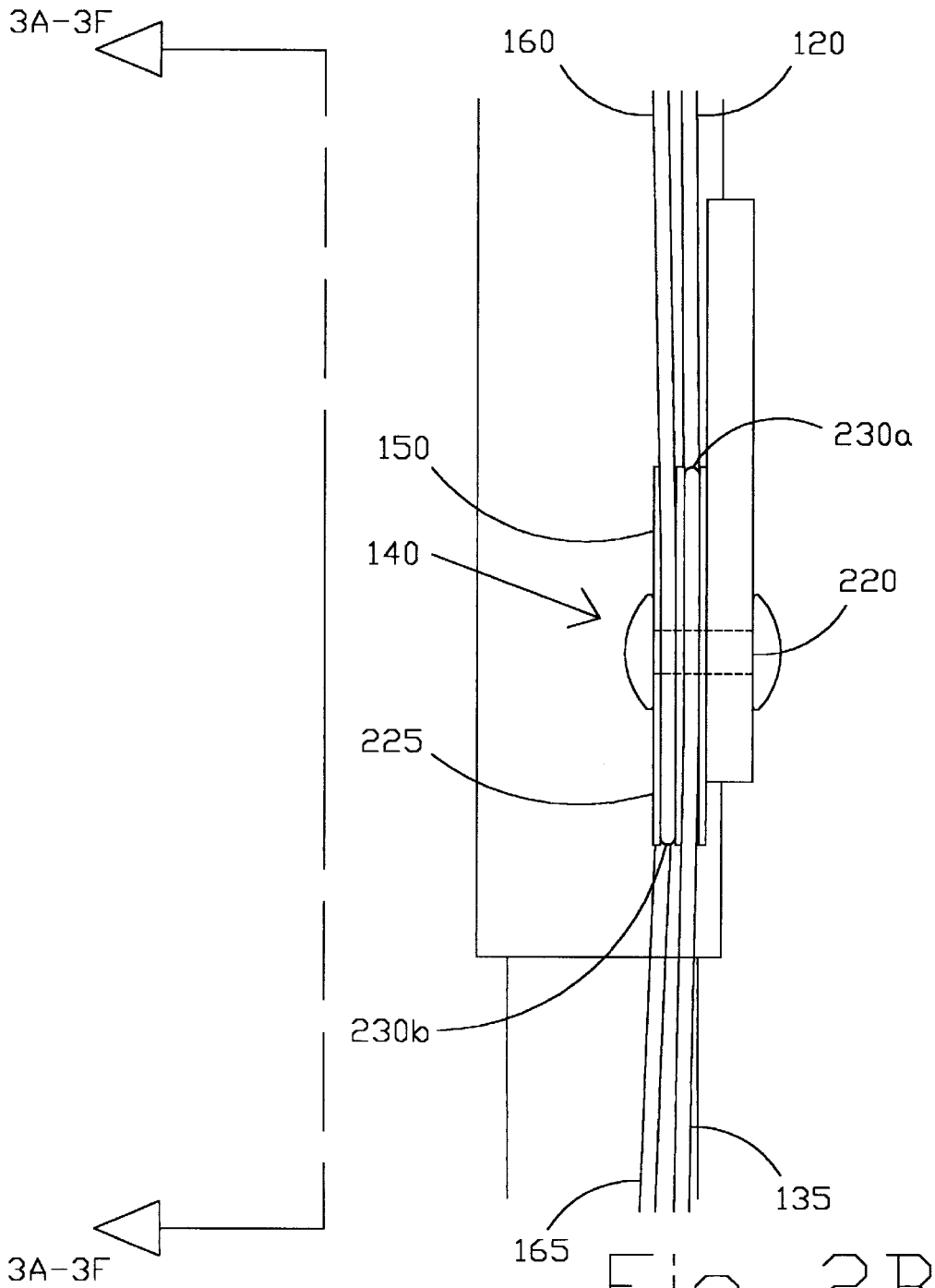
FIG. 2B is a partially sectioned view of a synchronizing pulley mechanism with a two passage synchronizing pulley.

FIG. 2B is a partially sectioned view of the synchronizing pulley mechanism 140 with a two passage synchronizing pulley 225. The two passage synchronizing pulley 225 is of a greater diameter than the four passage synchronizing pulley 155. The top and bottom power and limb strings must share the two passages 230*a* & 230*b*. The larger diameter of the two passage synchronizing pulley 225 provides each string with enough length of travel such that the two passage synchronizing pulley 225 only has to travel less than 180 degrees of rotation from a resting bow position (FIG. 1A) to a fully drawn position (FIG. 1B). Since the synchronizing pulley 225 has only two passages 230*a* & 230*b*, its mass and moment of inertia which involve both the diameter of the pulley and its mass, will be low and the torque generated by the synchronizing pulley 225 will be small. Other reference numerals found in FIG. 2B are similar to those found in FIG. 2A.

Figure 3A:
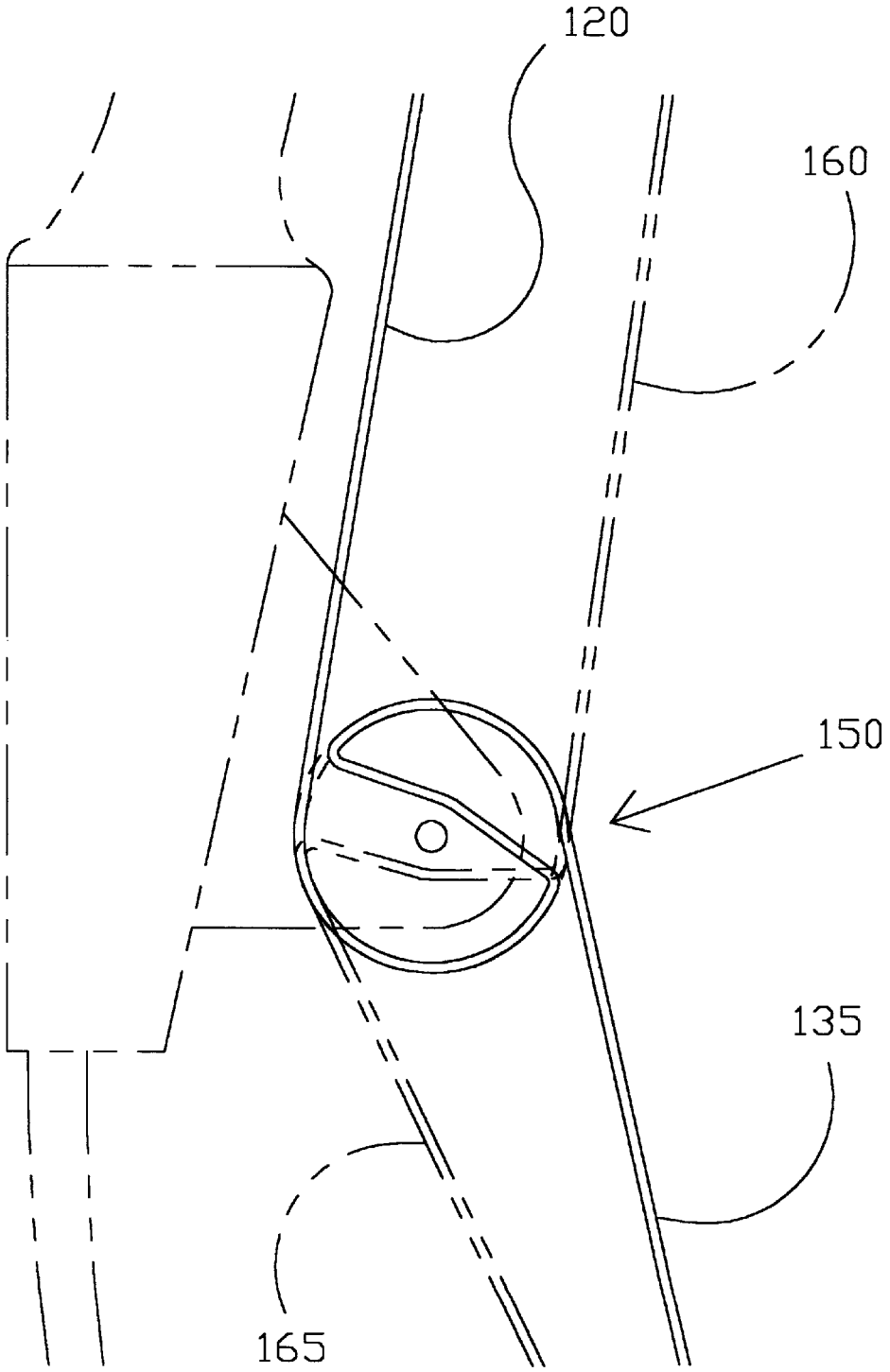
FIG. 3A is a partially sectioned view of a synchronizing pulley mechanism showing a top and bottom power string.
Figure 3B:
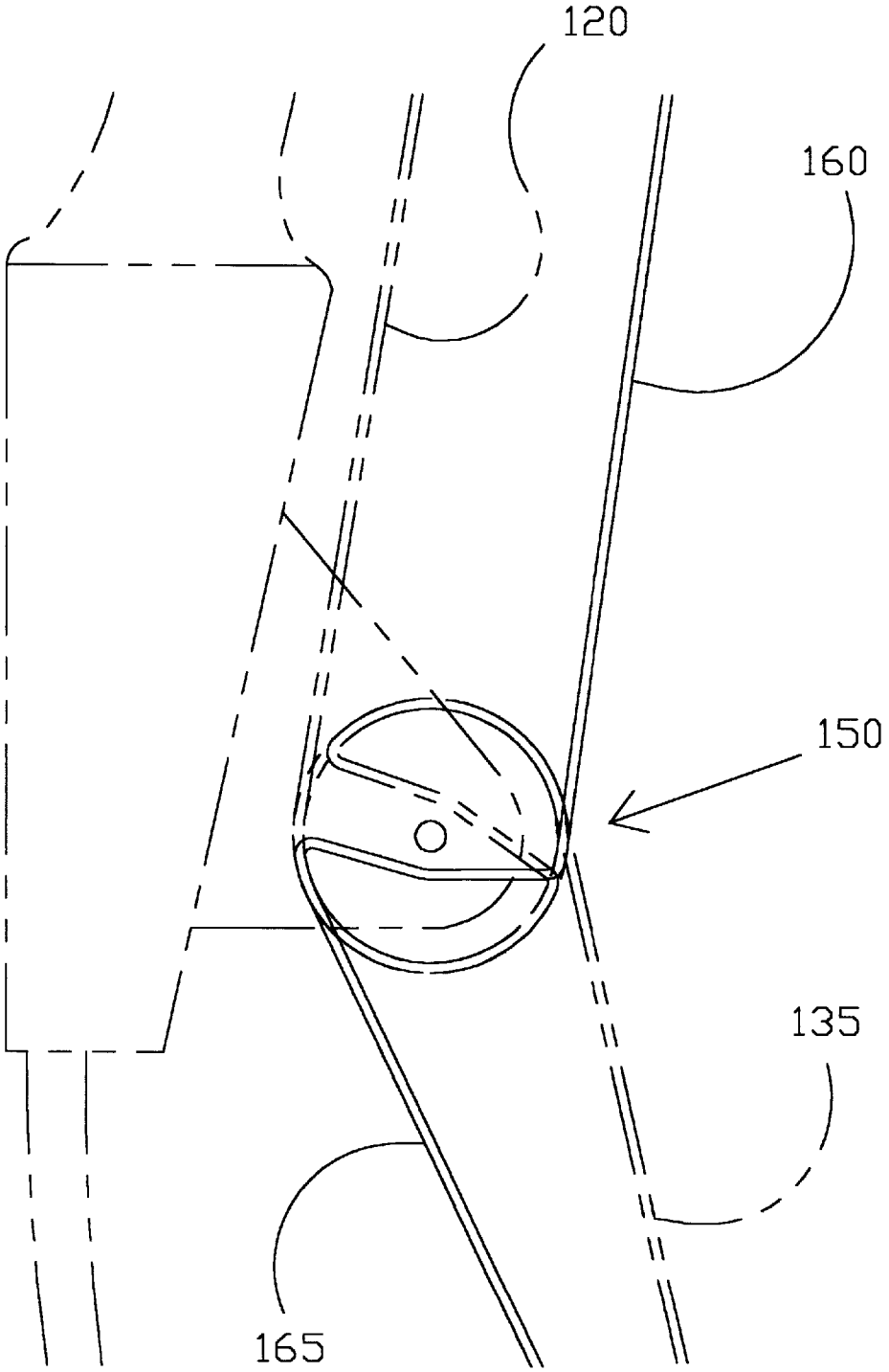
FIG. 3B is a partially sectioned view of a synchronizing pulley mechanism showing a top and bottom limb string.

FIGS. 3A–3F show partially sectioned views of the synchronizing pulley mechanism 140 shown in FIGS. 2A & 2B illustrating various alternate layout positions for the top and bottom limb and power strings. In FIG. 3A the top 120 and bottom 135 power strings can be joined together and contiguous as long as there is no slippage between the power strings 120 &135 and the synchronizing pulley means 150. The top and bottom power strings 120 & 135 can also be provided passage in their own respective passage of the synchronizing pulley means 150 with attachment being made between each of the power strings 120 & 135 and their respective passage. The top 120 or bottom 135 power strings therefore interface with the synchronizing pulley means 150 such that the synchronizing pulley means 150 provides for take-up and pay-out of the power strings 120 & 135 without slippage. FIG. 3B shows that the top and bottom limb strings can be joined together and contiguous if desired. The top 160 and bottom 165 limb strings can also be provided with an individual passage of the synchronizing pulley means 150. The aspect required of the present invention is that interface of the top 160 and bottom 165 limb strings and interface of the top 120 and bottom 135 power strings with the synchronizing pulley means 150 cannot allow for slippage between the strings 120, 135, 160, & 165 and the synchronizing pulley means 150 or the strings must pass along the synchronizing pulley means 150 such that the upper 20 and lower 30 flexible limbs are coupled to provide an equal amount of flexure during the draw or release of the draw string 85. Other components found in FIGS. 3A–3F bear similar reference numerals to those of FIG. 1A.

Figure 3C:
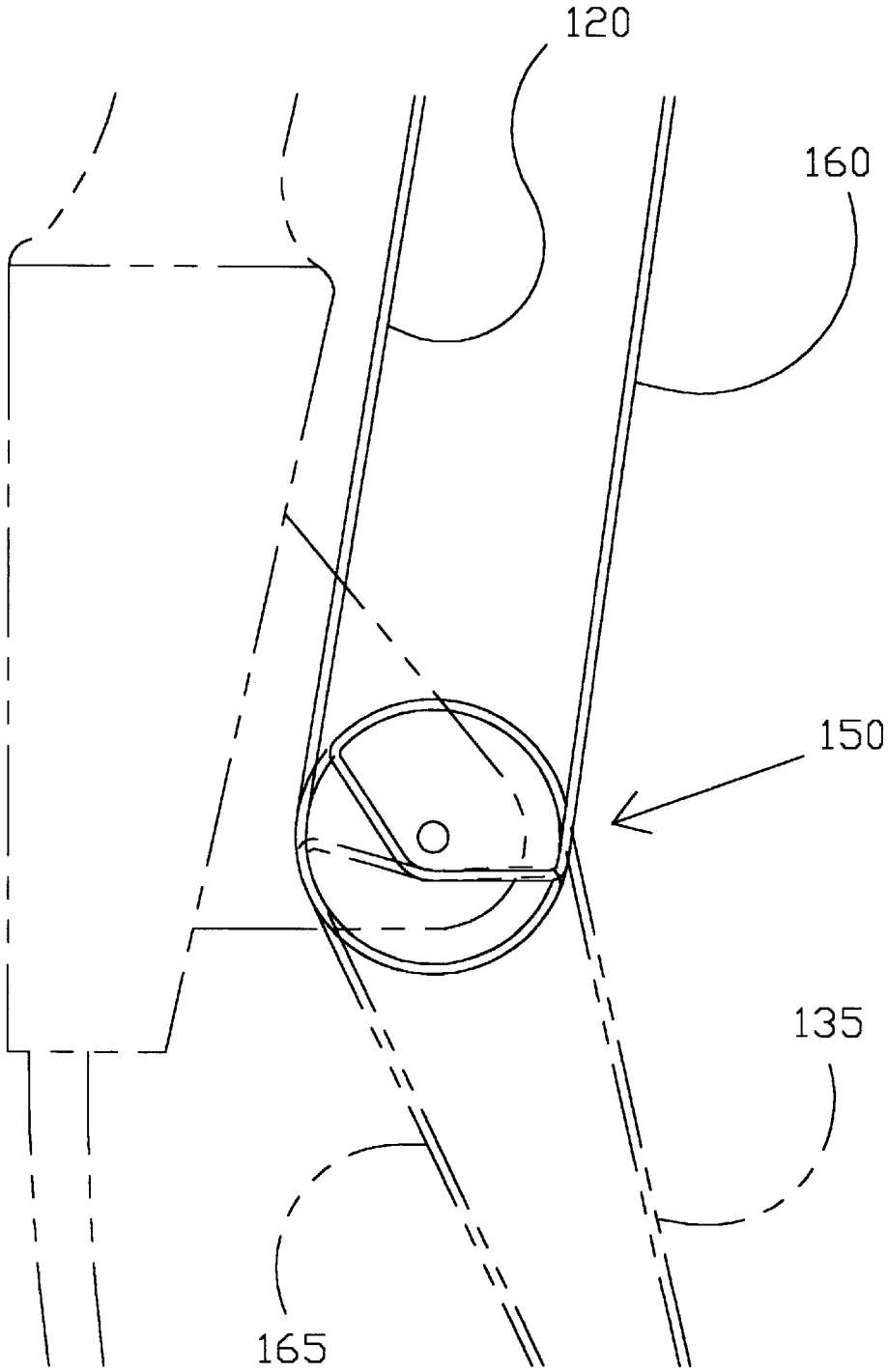
FIG. 3C is a partially sectioned view of a synchronizing pulley mechanism showing a top power string and a top limb string.
Figure 3D:
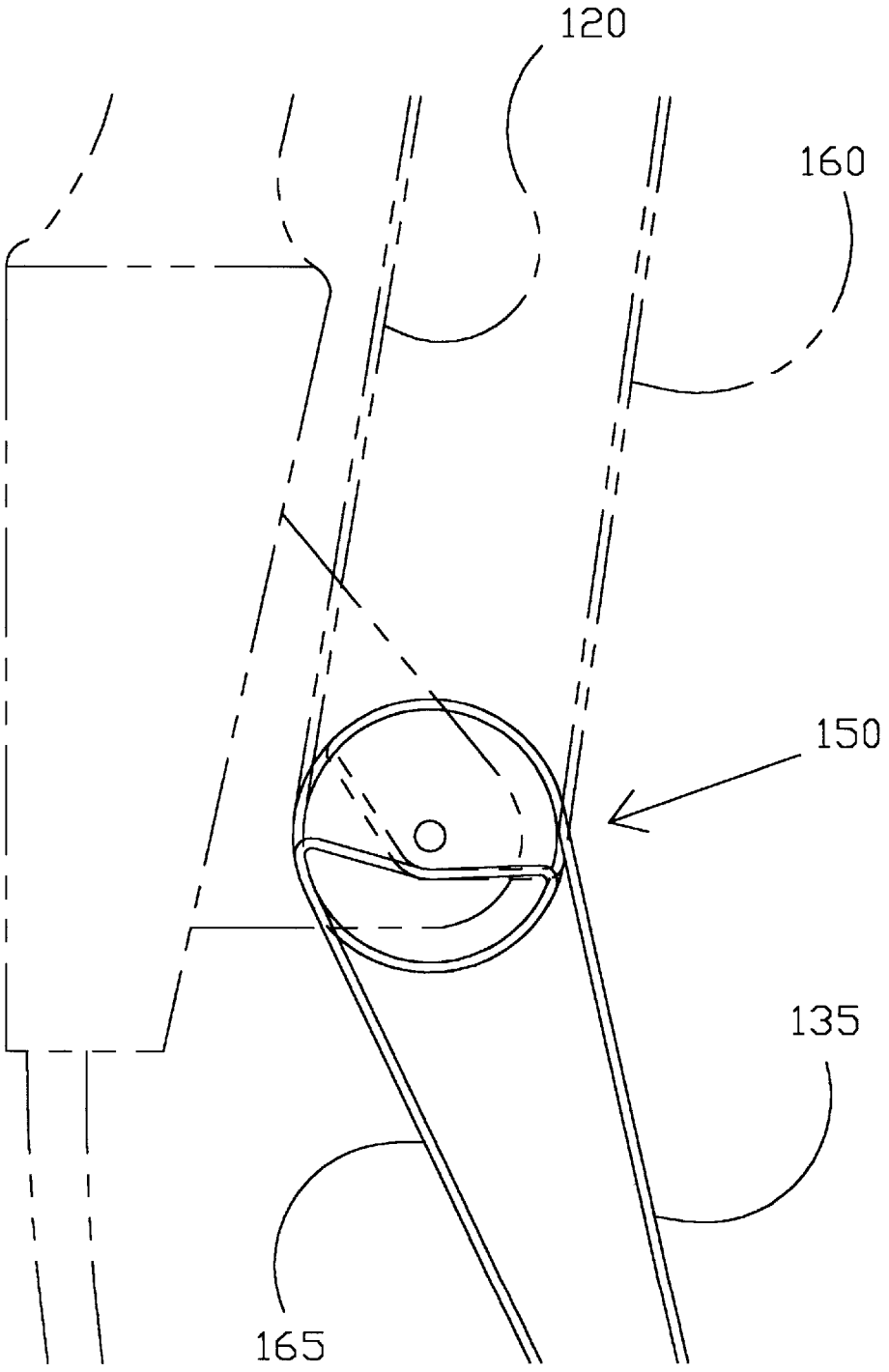
FIG. 3D is a partially sectioned view of a synchronizing pulley mechanism showing a bottom limb string and a bottom power string.

FIGS. 3C and 3D show that the top power string 120 can be joined and contiguous with the top limb string 160, and the bottom power string 135 can be joined and contiguous with the bottom limb string 165. This type of string layout could be accomplished with a two passage synchronizing pulley 225 if desired or with a one passage pulley with one common passage (not shown). In a manner similar to that described if FIGS. 3A and 3B the four strings described can also be provided with a separate passage in a four passage synchronizing pulley 155. Interface of the four strings 120, 135, 160, & 165 with the synchronizing pulley means 150 requires that the strings have passage along the synchronizing pulley means and that the resultant flexure of the upper 20 and lower 30 flexible limbs be equal during the draw of the draw string 85 or during launch of an arrow. This can occur if no slippage exists between any of the strings and the synchronizing pulley means 150 or if the strings are attached to each other.

Figure 3E:
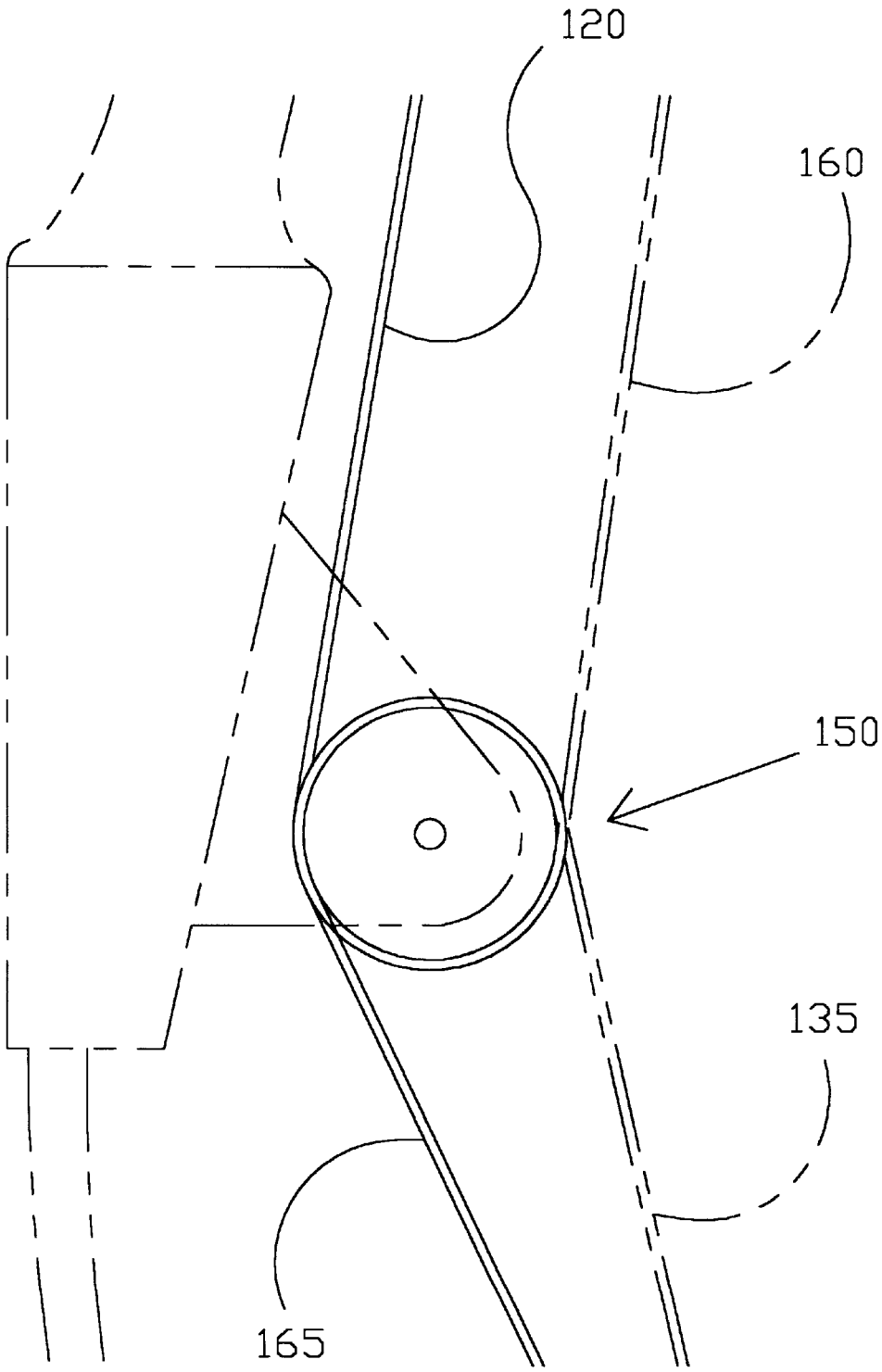
FIG. 3E is a partially sectioned view of a synchronizing pulley mechanism showing a top power string and a bottom limb string.
Figure 3F:
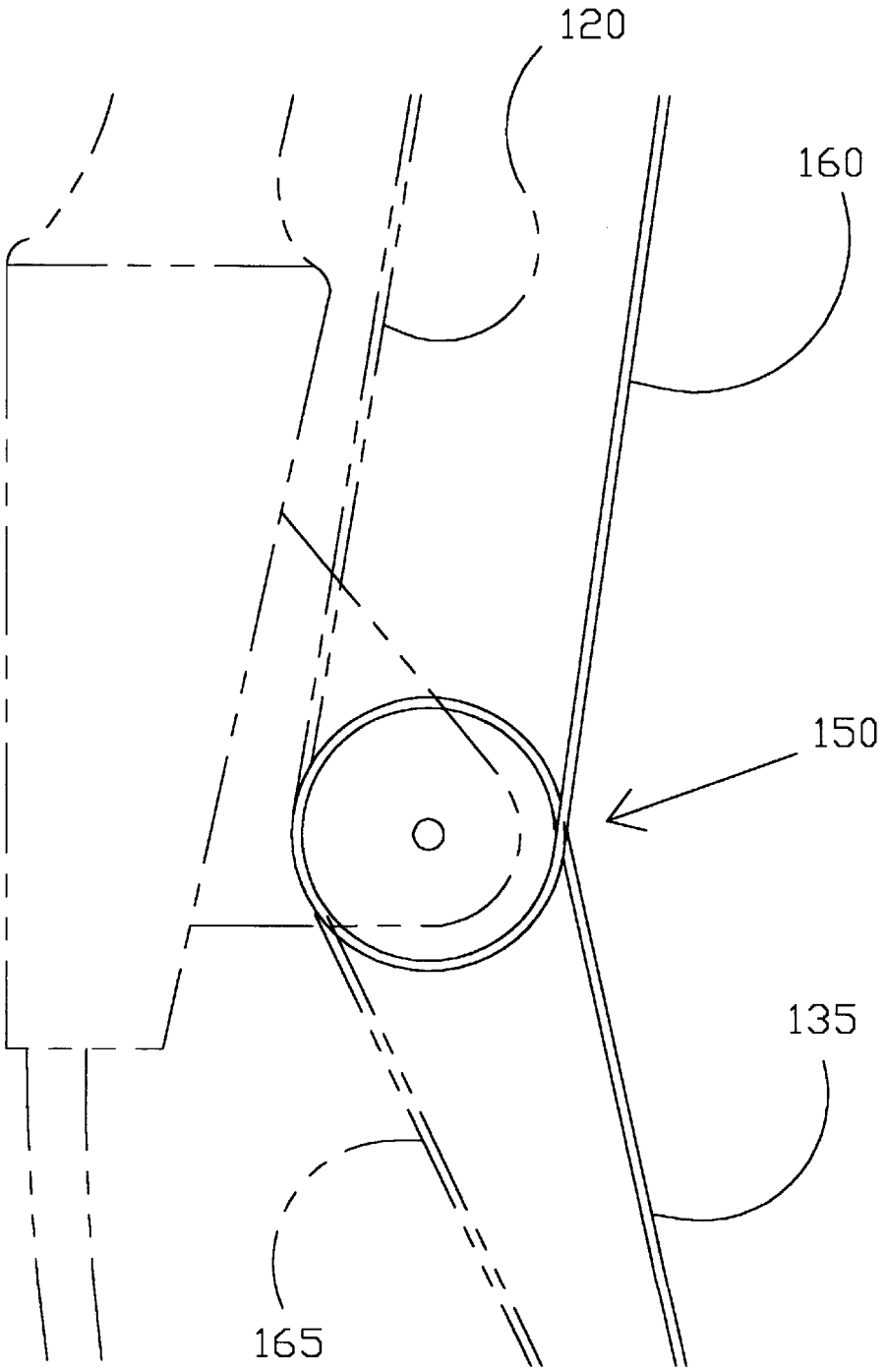
FIG. 3F is a partially sectioned view of a synchronizing pulley mechanism showing a top limb string and a bottom power string.

FIGS. 3E and 3F show the top power string 120 wrapping around the synchronizing pulley means 150 and being joined or contiguous with the bottom limb string 165. In a similar manner the top limb string 160 is shown wrapping around the synchronizing pulley means 150 and being joined or contiguous with the bottom power string 135. An arrangement of this kind would require that the synchronizing pulley means 150 be similar to the four passage synchronizing pulley 155. All of the arrangements of strings 120, 135, 160, & 165 and their interfaces with the synchronizing pulley means 150 shown in FIGS. 3A–3F will provide a coupling of the upper 20 and lower 30 flexible limbs such that they will move the same amount as each other regardless of differences in limb flexibility. The present invention teaches that an axisymmetric synchronizing pulley means of the type described that provides an interface to both the upper 20 and lower 30 flexible limbs and provides for equal movement of each flexible limb during the draw of the draw string 85 will control draw string 85 movement such that variations in flexibility from one limb to the other will not affect the movement of the nocking point 110 of the draw string 85 from a linear path resulting in a straight arrow launch.

Figure 4:
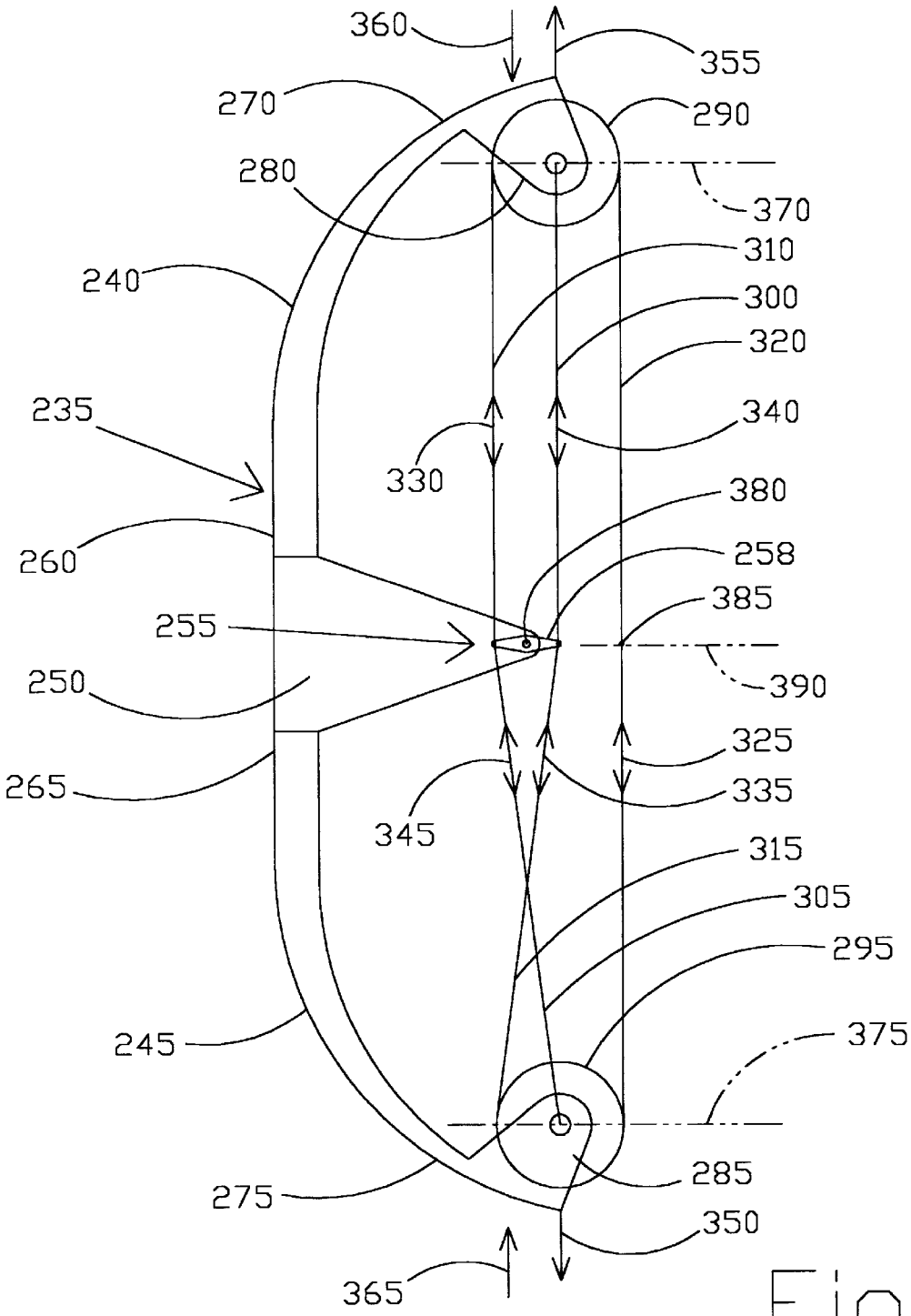
FIG. 4 is a simulated synchronized limb archery bow.

FIG. 4 is a simulated synchronized limb archery bow 235 intended to teach the concept of the synchronized archery bow 5 of the present invention and to better understand the operation of the synchronizing pulley mechanism 140. The simulation archery bow 235 describes the actual synchronized limb archery bow 5 shown in FIG. 1A with changes made to the orientation of the components in order to allow easier understanding of the synchronizing pulley mechanism 140. The names for the simulated components are the same as those used in FIG. 1A except that they are referred to as simulated components. For ease of description and understanding, only the vertical movement of the simulated upper 240 and lower 245 limbs will be described. The principles that apply are pertinent to the discussion of the actual synchronized limb archery bow 5 as shown in FIG. 1A.

The simulated handle-riser 250 is understood to be held in a fixed position in space. Rotationally attached to the simulated handle-riser 250 is a simulated synchronizing pulley means 255 that represents the four passage synchronizing pulley 155 or the two passage synchronizing pulley 225 or any synchronizing pulley means described in this invention. For the purposes of this discussion the simulated synchronizing pulley means 255 represents one or more axisymmetric pulleys that provide an equal lever arm to all strings that interface with it. The simulated synchronizing pulley means 255 is shown as a rotating lever arm 258. Proximal ends of simulated upper 260 and lower 265 flexible limbs are held in a fixed position in space due to attachment to the simulated handle-riser 250. Distal ends of the simulated upper 270 and lower 275 flexible limbs are attached to a simulated upper 280 and lower 285 limb pulley clevis, respectively. Rotatingly attached to the simulated upper 280 and lower 285 limb pulley devises are simulated upper 290 and lower 295 pulleys, respectively. The simulated upper pulley 290 represents a combination of the upper draw string cam pulley 50 and the upper power string cam pulley 55 shown in FIG. 1A or any other cam pulley means positioned on a flexible limb of a compound bow. The simulated lower pulley 295 similarly represents the lower draw string and power string cam pulleys 75 and 80, respectively, found in FIG. 1A. For the purposes of this discussion and for ease of understanding, the simulated upper 290 and lower 295 pulleys are considered round axisymmetric pulleys. A simulated top limb string 300 and a bottom limb string 305 interface with the simulated upper 280 and lower 285 limb pulley clevises, respectively, and with the simulated synchronizing pulley means 255. A simulated top power string 310 and bottom power string 315 interfaces with the simulated upper 290 and lower 295 pulleys, respectively, and with the simulated synchronizing pulley 255. Such interface requires either an attachment to or a lack of slippage between a string 300, 305, 310, & 315 and a simulated synchronizing pulley means 255. A simulated draw string 320 interfaces with the simulated upper 290 and lower 295 pulleys.

To best describe the operation of the simulated synchronizing limb archery bow 235, the tensions in the five simulated strings, draw string 320, top power string 310, bottom power string 315, top limb string 300, and bottom limb string 305 will be designated as: D 325, TP 330, BP 335, TL 340, and BL 345. The simulated synchronizing limb archery bow 235 is first fixed in space by the simulated handle-riser 250. The simulated lower flexible limb 245 exerts a lower flexible limb force, M 350, downward on the simulated lower limb pulley clevis 285 in accordance with the flexibility characteristics of the simulated lower flexible limb 245. The simulated upper flexible limb 240 exerts an upper flexible limb force, W 355, upward on the simulated upper limb pulley clevis 280 in accordance with its flexibility characteristics. Assume initially that no upper limb external force, FU 360, is exerted downward on the simulated upper flexible limb 240, and that no lower limb external force, FL 365, is exerted upward on the simulated lower flexible limb 245.

The equations that describe the tension in each of the five strings are found by making a force balance through the top sector 370 and the bottom sector 375. An additional equation defines a torque balance made along the axis 380 of the simulated synchronizing pulley means 255. Further it is recognized that the tension, D 325, is equal to tension TP 330 since the simulated upper pulley 290 is free to rotate to equalize this tension; the tension, D 325, is also equal to tension BP 335 since the simulated lower pulley 295 is free to rotate and equalize this tension. The following equations describe the equilibrium state for the simulated synchronizing limb archery bow 235:

$$TL + TP + D = W \quad \text{Eq. 1, top sector 370 force balance}$$

$$BP + BL + D = M \quad \text{Eq. 2, bottom sector 375 force balance}$$

$$TL + BL = TP + BP \quad \text{Eq. 3, torque balance on pulley means 255 around axis 380}$$

$$TP = D = BP \quad \text{Eq. 4, due to free rotation of pulleys 290 \& 380}$$

Solving equations 1–4 in terms of forces M 350 and W 355 gives:

$$BP=TP=D=(M+W)/6 \quad \text{Eq. 5}$$

$$TL=\tfrac{2}{3}\,W-\tfrac{1}{3}\,M \quad \text{Eq. 6}$$

$$BL=\tfrac{2}{3}\,M-\tfrac{1}{3}\,W \quad \text{Eq. 7}$$

Under the condition that force W 355 equals force M 350, the tension in all five strings D 325, TP 330, BP 335, TL 340, & BL 345 is equal to force M/3. If one, however, pushes downward on the simulated upper flexible limb 240 with an upper limb external force, FU 360, such that force W 355 is now equal to ½ M 350, then tension TL 340 is equal to zero. This means that the simulated top limb string 300 has become slack although no movement has occurred in either the simulated upper 240 or lower 245 flexible limb and the simulated nocking point 385 of the simulated draw string 320 has not moved. Under these conditions, tension BL 345 equals ½ M 350 and tension BP 335=TP 330=D 325=¼ M 350. As more force is applied to the simulated upper flexible limb 270, limb movement for both simulated flexible limbs 240 & 245 will occur in a downward direction with resultant movement of the simulated nocking point 385.

Since the simulated synchronizing archery bow 235 of FIG. 4 is constructed like a block and tackle mechanism, movement of the simulated upper flexible limb 240 downward by a single unit of length measure will result in the lowering of the simulated lower flexible limb 245 downward by only one half of that unit of length measure. As the simulated lower flexible limb 245 moves downward, the force, M 350, provided by this lower flexible limb 245 will reduce. As the simulated upper flexible limb 240 moves downward, the force, W 355, provided by the simulated upper flexible limb 240 will increase. As a result, movement will occur in both of the simulated flexible limbs 240 & 245 until the ratio of the force exerted by the simulated upper flexible limb, W 355 to the force exerted by the simulated lower flexible limb, M 350, again reaches the ratio of 1:2 and movement of the simulated upper 240 and lower 245 flexible limbs stops. After the simulated flexible limbs 240 & 245 have stopped their movement, the equilibrium balance described by the aforementioned equations 1–7 applies.

Under the condition that the force W 355 is less than ½ M 350, no movement will occur in the simulated flexible limbs 240 & 245 as shown in the above example. Under these circumstances then, the simulated upper flexible limb 240 can vary by as much as 50% of the flexibility of the simulated lower flexible limb 245 without observing any variation in the simulated nocking point 385 of the simulated draw string 320. Both the upper 240 and lower 245 simulated flexible limbs will be required to move the same amount during the draw of the simulated draw string 340 to a full drawn position (not shown for the simulated archery bow 235). The tension in the simulated top 340 and bottom 345 limb strings will be different in magnitude, but the displacement of both of the simulated flexible limbs 240 & 245 will be equivalent and the simulated nocking point 385 will therefore move on a linear path that is in line with the simulated centerline 390 of the simulated synchronizing limb archery bow 235. It is understood that application of a lower limb external force, FL 365, to the simulated lower flexible limb 245 will have a similar effect as was already described only in the opposite direction. If the lower flexible limb force, M 350, is less than ½ W 355, then the simulated bottom limb string 305 will become limp and both simulated flexible limbs 240 & 245 will move upward.

Standard compound archery bows maintain an equal tension in their top and bottom limb strings. The bow of this invention provides for equal movement of the limbs with top 160 and bottom 185 limb strings capable of supporting different tensions. The example of the simulated synchronizing limb archery bow 235 is a simplification to allow for ease of presentation of the concept being taught. The synchronized limb archery bow 5 presented in FIG. 1A contains cam pulleys 50, 55, 75, & 80 on the flexible limbs 20 & 30, has limb 160 & 165 and power 120 & 135 strings that travel at varying angles, and the upper 20 and lower 30 flexible limbs do not move in a vertical direction as described by the simulated archery bow 235. Nevertheless, the concept taught by the simulated example applies to the primary embodiment of the present invention and also to the additional embodiments to be presented. Small variations in flexibility found in the manufacture of flexible limbs have a major impact on the accuracy of standard compound bows without the synchronizing pulley mechanism 140 of the present invention. These variations will not affect the linear movement of the nocking point 110 of a compound bow that has the synchronizing pulley mechanism 140.

Figure 5A:
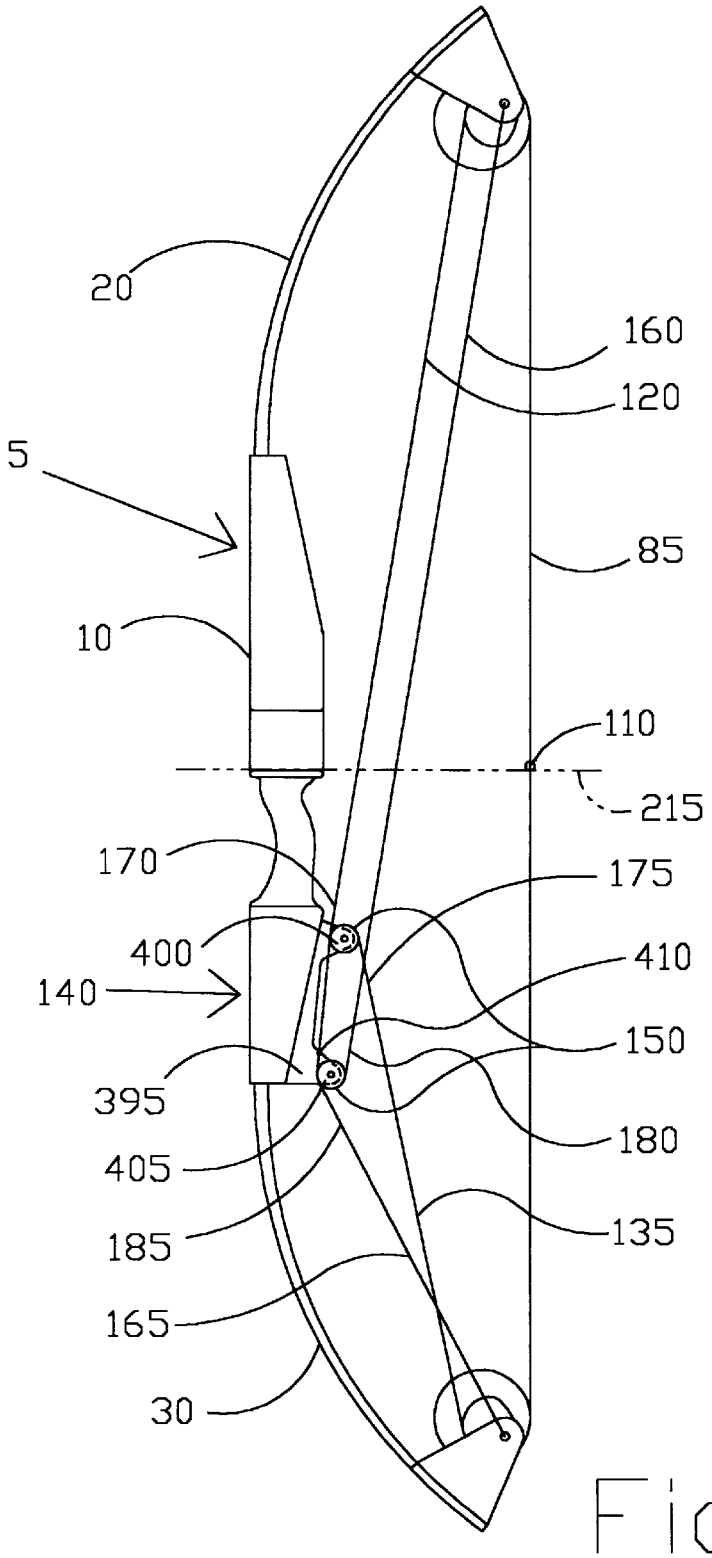
FIG. 5A is a plan view of an alternate embodiment of the synchronized limb archery bow of the present invention with synchronizing idler pulleys.

FIG. 5A is a plan view of an alternate embodiment of the synchronizing limb archery bow 5 of the present invention. The synchronizing pulley mechanism 140 has been modified; other components of the archery bow have retained the same reference numerals and description as presented in FIG. 1A. A synchronizing idler pulley clevis 395 is attached to the handle-riser 10 and provides rotational support for round axisymmetric upper 400 and lower 405 synchronizing idler pulleys. These idler pulleys 400 and 405 together form a synchronizing pulley means 150. The lower portion of the top power string 170 interfaces with the upper synchronizing idler pulley 400 and attaches to a string junction 410 (see also FIGS. 5B & 6) located between the two synchronizing idler pulleys 400 & 405. The bottom power string upper portion 175 interfaces with the upper synchronizing idler pulley 400 and attaches to the string junction 410. The top limb string lower end 180 and the bottom limb string upper 185 end pass along the lower synchronizing idler pulley 405 and attach to the string junction 410. Different string layout patterns can also be provided in a manner similar to that presented for the primary embodiment. The main teaching common to both the primary and this alternate embodiment is a synchronizing pulley mechanism 140 that contains a synchronizing pulley means 150 comprised of one or more axisymmetric pulleys and requires that the upper 20 and lower 30 flexible limbs move an equal displacement during the draw of the draw string 85. This controlled limb movement requires that the nocking point 110 move in a straight line in the direction of arrow travel along the centerline 215 of the bow 5 during arrow launch. One aspect of this alternate embodiment is the use of round idler pulleys 400 & 405 that are not attached to any of the power or limb strings 120, 135, 160, & 165. Since the strings 120, 135, 160, & 165 only pass over the idler pulleys 400 & 405 and allow for slippage, the idler pulleys can be formed of a smaller diameter than the average diameter of a typical cam pulley used in a standard compound archery bow and a smaller mass than an idler pulley or cam pulley of larger diameter. The smaller diameter idler pulley can undergo from approximately one half of a rotation to several rotations during the draw of the draw string 85 of during the launch of the arrow. The lower diameter and mass of the idler pulleys tends to reduce any torque generated by the synchronizing idler pulleys 400 & 405 and minimize any torquing effect on the archery bow 5 during arrow launch. Slippage between any of the four strings 120, 135, 160, & 165 and the two idler pulleys 400 & 405 is not of concern since the strings 120, 135, 160, & 165 are attached directly to each other at the string junction 410. The strings 120, 135, 160, and 165 interface with the two synchronizing idler pulleys but are tied together to prevent relative movement with respect to each other. The upper 20 and lower 30 flexible limbs are therefore required to flex an equal amount during the draw or release of the draw string 85.

Idler pulleys 400 and 405 can be formed of larger diameters that require less than one half of a rotation during the draw of the draw string and can also perform as idler pulleys as described in this embodiment with slippage possible between any of the four strings 120, 135, 160, and 165 and the two idler pulleys 400 & 405. Interface of the four strings with the idler pulleys could also be accomplished with non-slip passage or with attachment to the idler pulleys without deviating from the scope of this invention. In this case the term idler pulley would be understood to include the case of non-slip passage or allow for slippage between the four strings 120, 135, 160, and 165 and the idler pulleys 400 and 405.

Figure 5B:
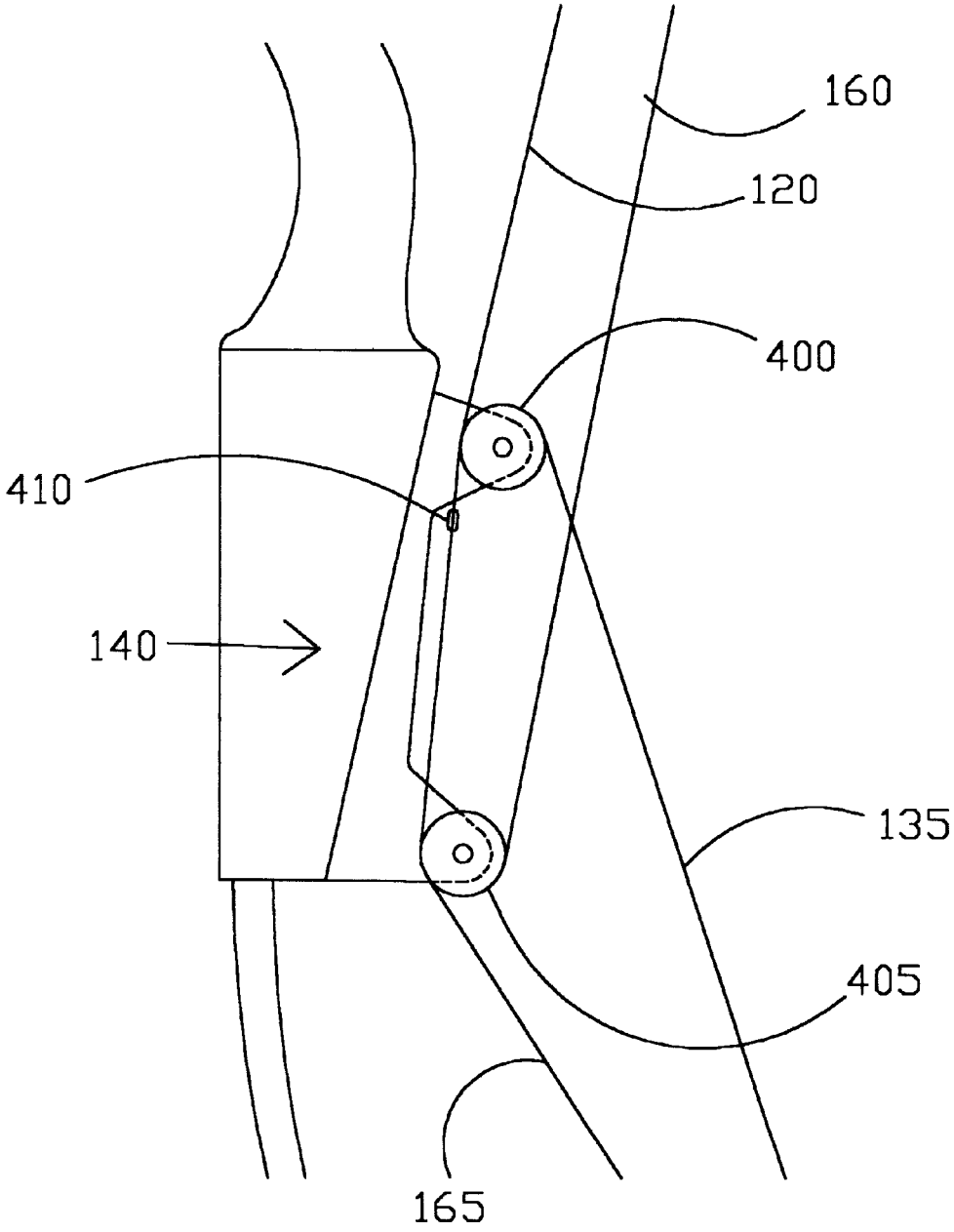
FIG. 5B is a plan view of a synchronizing pulley mechanism shown in FIG. 5A with the draw string in a full drawn position.

FIG. 5B is a plan view of the synchronizing pulley mechanism 140 shown in FIG. 5A with the draw string 85 in a full drawn position. The string junction 410 has moved to a position nearer to the upper two passage synchronizing idler pulley 400. The upper and lower flexible limbs 20 & 30 (see FIG. 5A) have flexed inward the same amount of travel since the limb strings 120, 135, 160, & 165 are attached to the same string junction 410. Other components bear the same reference numerals as shown in FIG. 5A.

Figure 6:
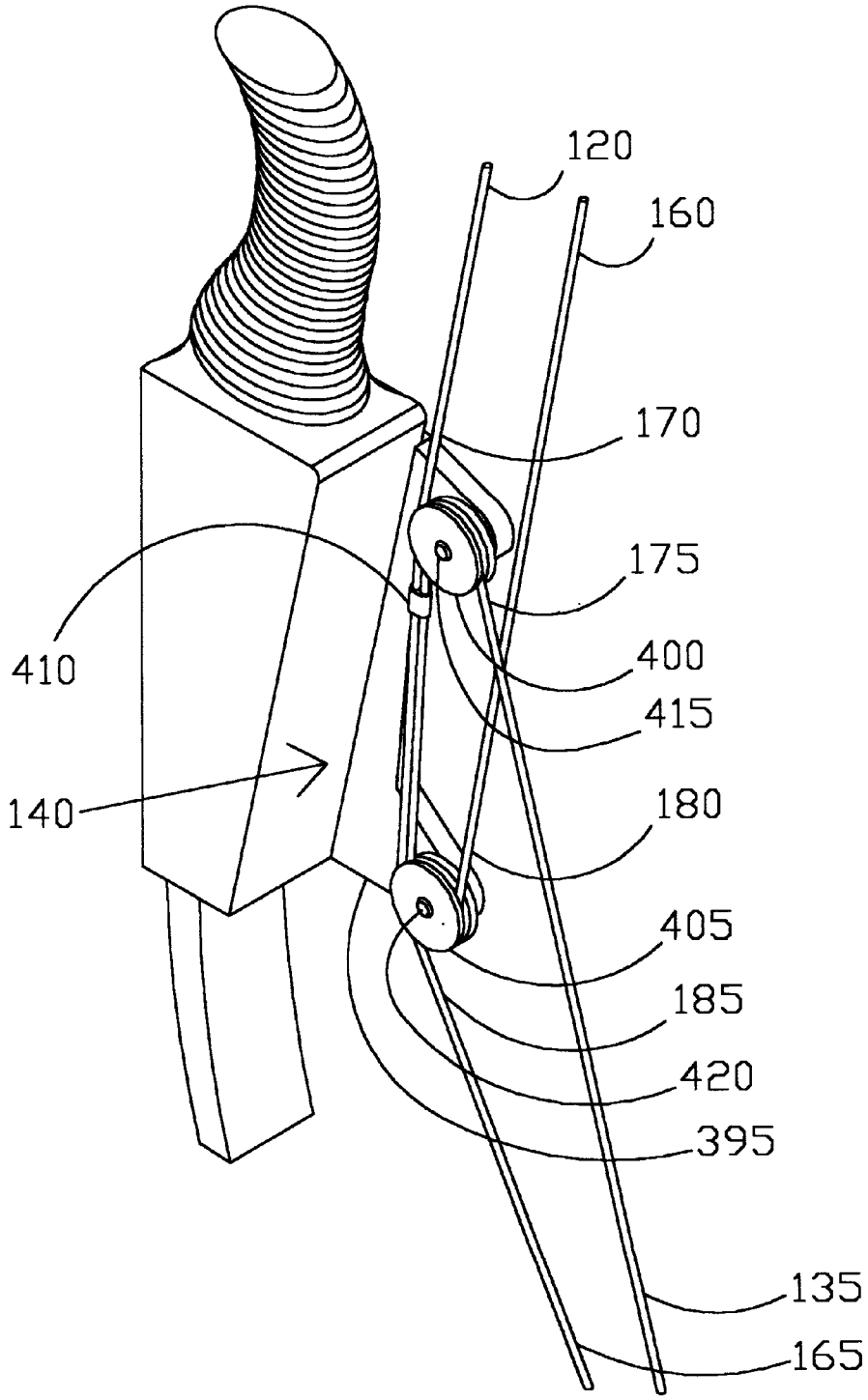
FIG. 6 is a isometric view of the synchronizing pulley mechanism shown in FIG. 5A.

FIG. 6 is an isometric view of the synchronizing pulley mechanism 140 of the alternate embodiment shown in FIG. 5A. A synchronizing idler pulley clevis 395 supports an upper 415 and a lower 420 synchronizing idler pulley axis that provides rotational support for the upper 400 and lower 405 synchronizing idler pulleys. The top power string lower end 170, bottom power string upper end 175, bottom limb string upper end 185, and top limb string lower end 180 all join at a common string junction 410. Both the top 120 and bottom 135 power strings are in the same passage of the upper synchronizing idler pulley 400, and a single passage is provided for the top 160 and bottom 165 limb strings in the lower synchronizing idler pulley 405. The upper 400 and lower 405 idler pulleys could be constructed with separate passages for each of these four strings and alternate pathways for routing these four strings can be employed without changing the function of this invention.

Figure 7:
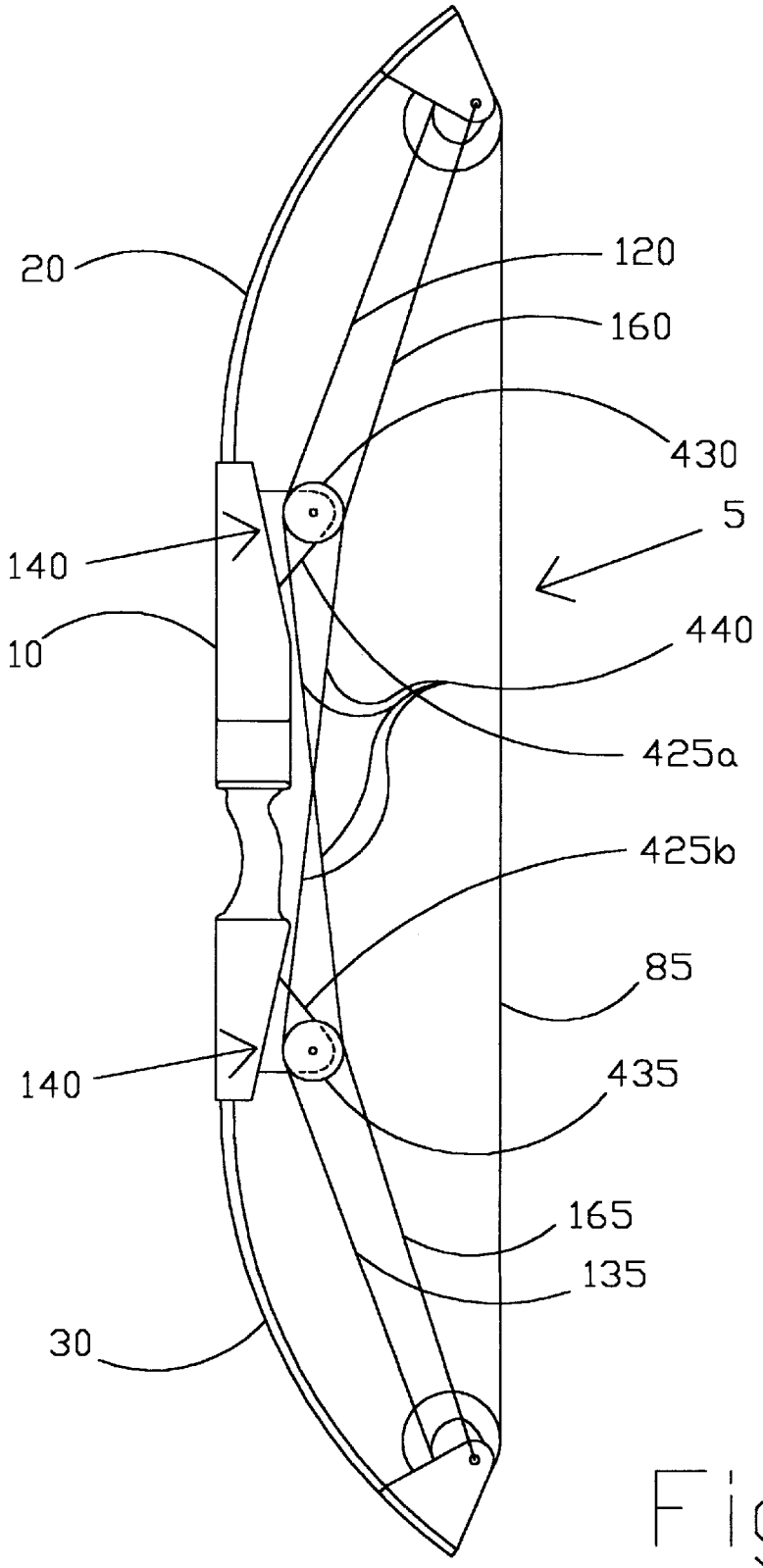
FIG. 7 is an alternate embodiment of the synchronizing limb archery bow with a coupling string.

FIG. 7 is still another embodiment of the synchronizing limb archery bow 5 of the present invention. The synchronizing pulley mechanism 140 has been modified; other components of the archery bow 5 have retained the same reference numerals and description as presented in FIG. 1A. An upper 425*a* and a lower 425*b* synchronizing pulley clevis is attached to the handle-riser 10 and provides rotational support for round axisymmetric upper 430 and lower 435 synchronizing pulleys, respectively. The top limb string 160 and the top power string 120 interface with the upper synchronizing pulley 430. The top limb string 160 and the top power string 120 can be joined and contiguous and pass along the upper synchronizing pulley 430 so long as slippage does not occur with respect to the upper synchronizing pulley 430. The top limb string 160 and top power string 120 can each interface with a separate passage of the upper synchronizing pulley 430 and can be attached to that synchronizing pulley 430. The top limb string 160 and top power string 120 therefore interface with the upper synchronizing pulley 430 with a pay-out and take-up of these strings 160 & 120 by the upper synchronizing pulley 430. Similarly, the bottom limb string 165 and bottom power string 135 interface with the lower synchronizing pulley 435. An additional coupling string 440 interfaces with the upper 430 and lower 435 synchronizing pulley. The coupling string 440 can cross over itself as shown in FIG. 7 such that the upper 430 and lower 435 synchronizing pulleys rotate in opposite directions during the draw of the draw string 85 or during launch of the arrow. This allows the torque generated by the two synchronizing pulleys 430 & 435 to cancel each other and not transmit any torque to the archery bow 5. The upper 20 and lower 30 flexible limbs are required to flex an equal amount during the draw of the draw string 85 from a resting position to a full drawn position and during launch of an arrow.

Figure 8:
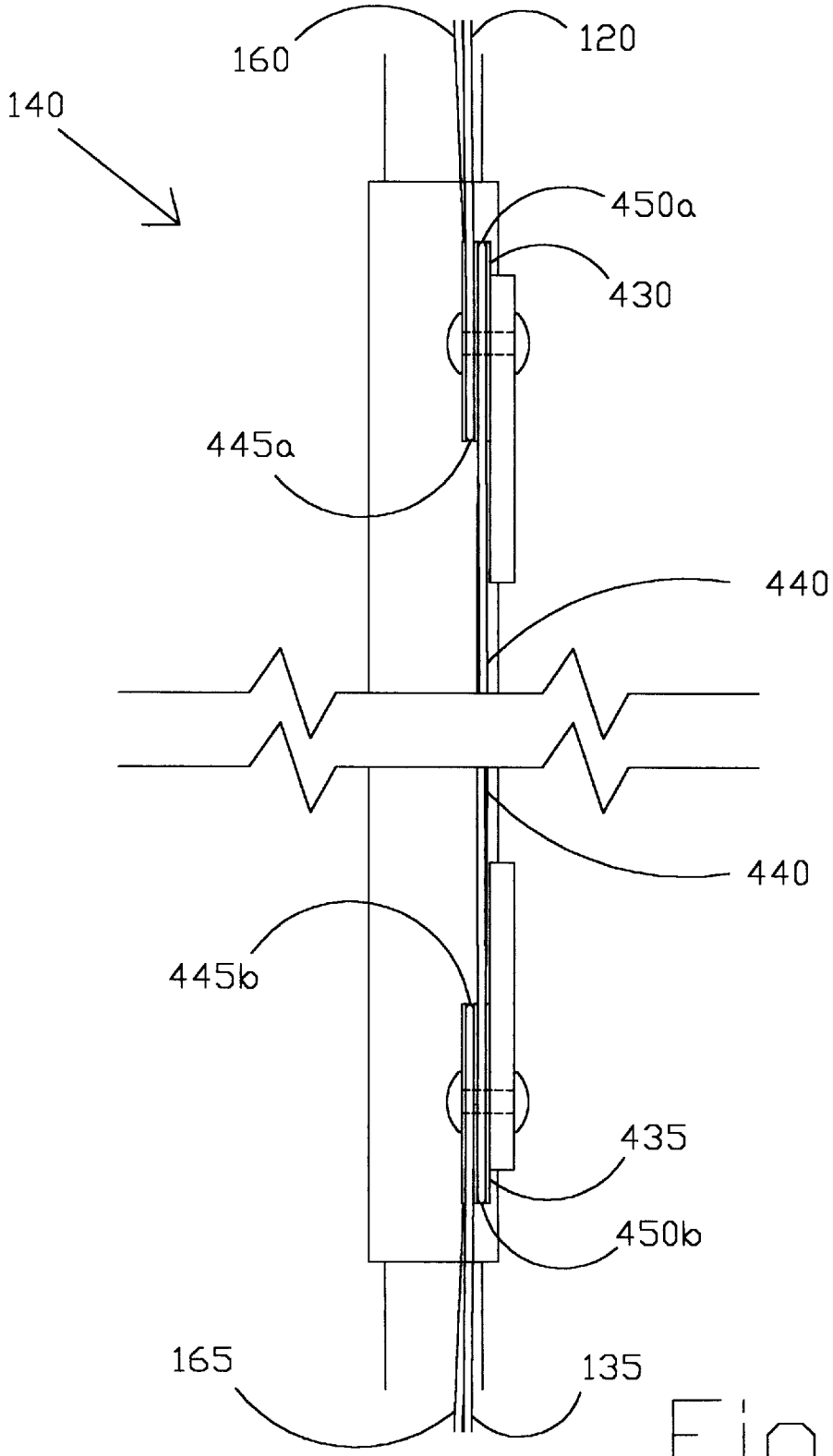
FIG. 8 is a partially sectioned view of the synchronizing pulley mechanism shown in FIG. 7.

FIG. 8 is a partially sectioned view of the synchronizing pulley mechanism 140 of the embodiment of the synchronizing limb archery bow 5 shown in FIG. 7. The top power string 120 and top limb string 160 are provided with a passage 445*a* in the upper synchronizing pulley 430. The top limb 160 and power strings 120 can interface with the same passage of the upper synchronizing pulley 430 provided that slippage does not occur between the strings and the synchronizing pulley, or separate passages (not shown) can be provided by the upper synchronizing pulley 430. The bottom power string 135 and bottom limb string 165 are provided with a passage 445*b* in the lower synchronizing pulley 435. The bottom limb 165 and power strings 135 can interface with the same passage of the lower synchronizing pulley 435 as long as slippage does not occur between the strings 165 & 135 and the synchronizing pulley 435; a separate passage (not shown) can be provided for each bottom string 135 & 165 in the synchronizing pulley 435. The coupling string 440 interfaces with separate passages 450*a* & 450*b* of the upper 430 and the lower 435 synchronizing pulley. This coupling string 440 requires that the upper 20 and lower 30 flexible limbs move the same amount during the draw of the draw string 85 (FIG. 7) regardless of differences in limb flexibility.

Mode of Operation

The mode of operation for all embodiments of the bow of the present invention is the same and reference can be made to FIGS. 1–8. To use the synchronizing limb archery bow 5, the upper 50 & 55 and lower 75 & 80 cam pulleys are first synchronized to appropriately match lever arms 100, 105, 107, & 108 being provided to the draw string 85 and power strings 120 & 135. An arrow (not shown) is then attached to the nocking point 110 of the draw string 85. As the draw string 85 is drawn to a full drawn position (see FIG. 1B), the upper 20 and lower 30 flexible limbs will flex from their initial resting state to their final flexed state and the draw string 85 is payed out of the upper 50 and the lower 75 draw string cam pulleys as they rotate. The upper power string cam pulley 55 is typically joined to the upper draw string cam pulley 50 and hence it is also required to rotate. Similarly the lower power string cam pulley 80 is required to rotate along with the lower draw string cam pulley 75. Rotation of the upper 55 and lower 80 power string cam pulleys causes take-up of the top 120 and bottom 135 power string and resultant rotation of the synchronizing pulley means 150. The synchronizing pulley means is coupled to the upper 20 and lower 30 flexible limbs causing each flexible limb to flex an equal amount independent of variations in flexibility from one limb to the other. During the launch of the arrow, each flexible limb flexes back to its initial resting position. Since the upper 20 and lower 30 flexible limbs each flex the same amount, the nocking point

110 will move in a straight line along the centerline 215 of the archery bow 5 and launch the arrow with greater accuracy than a standard compound bow with cams positioned on flexible limbs and without the synchronizing pulley mechanism 140.

Variations in limb flexibility of only a few percent can significantly affect the accuracy of a standard compound bow without the synchronizing pulley mechanism 140. With the synchronizing pulley mechanism 140, the variation in limb flexibility can be significantly higher without producing any movement of the nocking point 110 in a direction not parallel with the centerline 215. Under the conditions presented in the example of the simulated synchronizing limb archery bow 235, limb variation from one limb to the other can be as much as fifty percent without nonlinear movement of the simulated nocking point 385 during arrow launch. The archery bow 5 of the present invention can be produced at a lower cost due to reduced requirements currently being placed on ensuring limb flexibility balance between the two flexible limbs.

REFERENCE NUMERALS IN DRAWINGS

5 Synchronized Limb Archery Bow
10 Handle-Riser
15 Upper Flexible Limb Proximal End
20 Upper Flexible Limb
25 Lower Flexible Limb Proximal End
30 Lower Flexible Limb
35 Upper Flexible Limb Distal End
40 Upper Limb Pulley Clevis
45 Upper Clevis Axle
50 Upper Draw string Cam Pulley
55 Upper Power String Cam Pulley
60 Lower Flexible Limb Distal End
65 Lower Limb Pulley Clevis
70 Lower Clevis Axle
75 Lower Draw String Cam Pulley
80 Lower Power String Cam Pulley
85 Draw String
90 Upper End of Draw String
95 Lower End of Draw String
100 Upper Draw String Lever Arm
105 Lower Draw String Lever Arm
107 Upper Power String Lever Arm
108 Lower Power String Lever Arm
110 Nocking Point
115 Clockwise Direction
120 Top Power String
125 Upper End of Top Power String
130 Bottom Power String Lower End
135 Bottom Power String
140 Synchronizing Pulley Mechanism
145 Synchronizing Pulley Mechanism Clevis
150 Synchronizing Pulley Means
155 Four Passage Synchronizing Pulley
160 Top Limb String
165 Bottom Limb String
170 Lower End of Top Power String
172*a* Passage
172*b* Passage
172*c* Passage
172*d* Passage
175 Upper End of Bottom Power String
180 Lower end of Top Limb String
185 Upper End of Bottom Limb String
190 Top Limb String Upper End
195 Top Limb String Attachment Site
200 Lower End of Bottom Limb String
205 Bottom Limb String Attachment Site
210 Counterclockwise Direction
212 Clockwise Direction
215 Centerline
217*a*Diametrical Lever Arm
217*b* Diametrical Lever Arm
217*c* Diametrical Lever Arm
217*d* Diametrical Lever Arm
220 Synchronizing Pulley Axle
225 Two Passage Synchronizing Pulley
230*a* Passage
230*b* Passage
235 Simulated Synchronized Limb Archery Bow
240 Simulated Upper Flexible Limb
245 Simulated Lower Flexible Limb
250 Simulated Handle-Riser
255 Simulated Synchronized Pulley Means
258 Rotating Lever Arm
260 Proximal End of Upper Flexible Limb
265 Proximal End of Lower Flexible Limb
270 Distal End of Simulated Upper Flexible Limb
275 Distal End of Simulated Lower Flexible Limb
280 Simulated Upper Limb Pulley Clevis
285 Simulated Lower Limb Pulley Clevis
290 Simulated Upper Pulley
295 Simulated Lower Pulley
300 Simulated Top Limb String
305 Simulated Bottom Limb String
310 Simulated Top Power String
315 Simulated Bottom Power String
320 Simulated Draw String
325 Tension in Simulated Draw String
330 Tension in Top Power String
335 Tension in Bottom Power String
340 Tension in Top Limb String
345 Tension in Bottom Limb Sting
350 Force Exerted by Lower Flexible Limb
355 Force Exerted by Upper Flexible Limb
360 Upper Limb External Force
365 Lower Limb External Force
370 Top Sector
375 Bottom Sector
380 Axis of Simulated Synchronizing Pulley
385 Simulated Nocking Point
390 Simulated Centerline
395 Synchronizing Idler Pulley Clevis
400 Upper Synchronizing Idler Pulley
405 Lower Synchronizing Idler Pulley
410 String Junction
415 Upper Synchronizing Idler Pulley Axis
420 Lower Synchronizing Idler Pulley Axis
425*a* Upper Synchronizing Pulley Clevis
425*b* Lower Synchronizing Pulley Clevis
430 Upper Synchronizing Pulley
435 Lower Synchronizing Pulley
440 Coupling String
445*a* Passage
445*b* Passage
450*a* Passage
450*b* Passage Various modifications can be made to the present invention without departing from the apparent scope hereof.

We claim:

1. In an archery bow for launching an arrow, having an upper cam pulley means attached to a distal end of an upper flexible limb, for providing a let-off of force to a draw string in a full drawn position, and having a handle-riser with an upper and a lower end, the upper end being attached to a proximal end of the upper flexible limb, and having a lower flexible limb with a proximal end and a distal end, the proximal end of the lower flexible limb being attached to the lower end of the handler-riser, and the distal end of the flexible limb being attached to a lower cam pulley means, the lower cam pulley means providing additional let-off of force to the draw string in a full drawn position, and the archery bow having an upper power string having passage along the upper cam pulley means, and the archery bow having a lower power string having a passage along the lower cam pulley means, and the archery bow having an upper limb string attached to the distal end of the upper limb, and having a lower limb string attached to the distal end of the lower limb, and having a draw string with an upper end and a lower end, the upper end having passage along the upper cam pulley means, and the lower end having passage along the lower cam pulley means, the archery bow improvement comprising;

A. a synchronizing pulley means attached to the handle-riser, said synchronizing pulley means comprising one or more axisymmetric synchronizing pulleys that provide passage for the upper power string, the lower power string, the upper limb string, and the lower limb string, and the power and limb strings do not slip with respect to each other;

B. the upper and lower flexible limbs being coupled to said synchronizing pulley means via the upper and lower limb strings such that take-up and pay-out of the upper and lower limb strings are equal, requiring that both limbs move equal amounts in a synchronous manner.

2. The archery bow improvement of claim 1 wherein said synchronizing pulley means comprises a single axisymmetric synchronizing pulley.

3. The archery bow improvement of claim 2 wherein said axisymmetric synchronizing pulley has one or more passages for the top and bottom limb strings and the top and bottom power strings.

4. The archery bow improvement of claim 3 wherein all of said passages of said axisymmetric synchronizing pulley are of the same diameter.

5. The archery bow improvement of claim 3 wherein at least one of said passages of said axisymmetric synchronizing pulley has a diameter that is different than another of said passages of said axisymmetric synchronizing pulley.

6. The archery bow improvement of claim 2 wherein said axisymmetric synchronizing pulley has two or more passages for the top and bottom limb strings and the top and bottom power strings.

7. The archery bow improvement of claim 2 wherein said axisymmetric synchronizing pulley has four passages for the top and bottom limb strings and the top and bottom power strings.

8. The archery bow improvement of claim 1 wherein said synchronizing pulley means is attached to the top and bottom limb strings and to the top and bottom power strings.

9. The archery bow improvement of claim 1 wherein said synchronizing pulley means comprises two axisymmetric synchronizing idler pulleys, a first axisymmetric synchronizing idler pulley and a second axisymmetric synchronizing idler pulley.

10. The archery bow improvement of claim 9 wherein at least one of said axisymmetric synchronizing idler pulleys provides passage for the top and bottom limb strings.

11. The archery bow improvement of claim 9 wherein said first axisymmetric synchronizing idler pulley provides passage for the top and bottom power strings and the second axisymmetric synchronizing idler pulley provides passage for the top and bottom limb strings.

12. The archery bow improvement of claim 9 wherein said first axisymmetric synchronizing idler pulley provides passage for said top and bottom limb strings and said second axisymmetric synchronizing idler pulley provides passage for the top and bottom power strings.

13. The archery bow improvement of claim 9 wherein said axisymmetric synchronizing idler pulleys provide passage for and are not attached to the top or bottom power string or to the top or bottom limb string.

14. The archery bow improvement of claim 9 wherein said axisymmetric synchronizing idler pulleys are of a smaller diameter and mass than a larger diameter pulley of greater mass to allow for at least one half of a complete rotation during the launch of the arrow, said axisymmetric synchronizing idler pulleys imparting a generally insignificant moment of inertia.

15. The archery bow improvement of claim 9 wherein the top and bottom limb strings and the top and bottom power strings are attached together at a string junction.

16. The archery bow improvement of claim 9 wherein said first axisymmetric synchronizing idler pulley and said second axisymmetric synchronizing idler pulley each contain at least one passage.

17. The archery bow improvement of claim 1 wherein said synchronizing pulley means comprises two axisymmetric synchronizing coupled pulleys, a first axisymmetric synchronizing coupled pulley that provides passage without slippage with the top power and limb string, and a second axisymmetric synchronizing coupled pulley that provides passage without slippage with the bottom power and limb string, said first and second axisymmetric synchronizing coupled pulleys being coupled together by a coupling string, that requires that said first and second axisymmetric synchronizing coupled pulleys rotate an equal amount.

18. The archery bow improvement of claim 17, wherein said coupling string provides a counterrotation of said coupled pulleys during arrow launch and providing no net torque input to the archery bow.

19. The archery bow improvement of claim 1 wherein said axisymmetric synchronizing pulley provides that upper and lower flexible limbs having different flexibilities of less than about fifty percent of each other will flex an equal amount during the drawing of the draw string from a resting to a full drawn position and during the release of the draw string from a full drawn position to a resting position, thereby providing a linear movement of the nocking point along a centerline of the archery bow.

20. The archery bow improvement of claim 1 wherein said synchronizing pulley means is coupled to the upper and lower cam pulley means via the upper and lower power strings such that take-up and pay-out of the upper and lower power strings are equal, and such that take-up and pay-out of the draw string upper and lower ends are equal, thereby providing linear movement of the nocking point.

21. In a compound archery bow for launching an arrow with a handle-riser having an upper and a lower flexible limb attached thereto, the upper flexible limb having a distal end with an upper cam pulley means attached thereto and the lower flexible limb having a distal end with a lower cam pulley means attached thereto, the upper and lower cam pulley means providing a let-off of force to the draw string in a full drawn position, the draw string with an upper end and a lower end, the upper end having passage along the upper cam pulley means and the lower end having passage along the lower cam pulley means, a top power string with an upper end having passage along the upper cam pulley means, a bottom power string with a lower end having passage along the lower cam pulley means, a top limb string with an upper end attached to the distal end of the upper flexible limb, a bottom limb string with a lower end attached to the distal end of the lower flexible limb, the flexible limbs having a resting and a full drawn position, the archery bow improvement comprising;

A. a synchronizing pulley means attached to the handle-riser, said synchronizing pulley means comprised of one or more axisymmetric pulleys with one or more grooves for strings wherein the upper power string and the lower power string are provided passage in at least one of said one or more grooves of equal radius and the upper limb string and the lower limb string are provided passage in at least one of said one or more grooves of equal radius;

B. said synchronizing pulley means having an axisymmetric geometry such that when rotated, the upper and lower limb strings are taken up and paid out an equal amount providing a coupling between the upper flexible limb and the synchronizing pulley means via the upper limb string and a coupling between the lower flexible limb and the synchronizing pulley means via the lower limb string requiring that both limbs move equal amounts in a synchronous manner.

22. The archery bow improvement of claim 21 wherein the top limb string is joined to or contiguous with the top power string, and the bottom power string is joined to or contiguous with the bottom limb string.

23. The archery bow improvement of claim 21 wherein the top power string is joined to or contiguous with the bottom power string, and the top limb string is joined to or contiguous with the bottom limb string.

24. The archery bow improvement of claim 21 wherein the top power string is joined to or contiguous with the bottom limb string, and the top limb string is joined to or contiguous with the bottom power string.

25. In a compound archery bow with a handle-riser having an upper and a lower flexible limb attached thereto, the upper flexible limb having a distal end with an upper cam pulley means attached thereto and the lower flexible limb having a distal end with a lower cam pulley means attached thereto, the upper and lower cam pulley means providing a let-off of force to a draw string in a full drawn position, the draw string with an upper end and a lower end, the upper end having passage along the upper limb cam pulley means and the lower end having passage along the lower limb cam pulley means, the upper and lower flexible limbs exerting a force upon the draw string in a resting position, a top power string having passage along the upper limb cam pulley means, a bottom power string having passage along the lower limb cam pulley means, a top limb string attached to the distal end of the upper flexible limb, a bottom limb string attached to the distal end of the lower flexible limb, the flexible limbs having a resting position and a full drawn position, the archery bow improvement comprising;

A. a synchronizing pulley means attached to the handle-riser, said synchronizing pulley means comprised of at least one axisymmetric pulley that couples the upper flexible limb with the lower flexible limb via the upper and lower limb strings such that the upper and lower flexible limbs flex an equal amount from a resting position to a full drawn position and from a full drawn position back to a resting position;

B. said synchronizing pulley means providing passage for the upper power string, the lower power string, the upper limb string, and the lower limb string, and the power and limb strings do not slip with respect to each other.

26. The archery bow improvement of claim 25 wherein said synchronizing pulley means couples the upper and lower flexible limbs via the upper and lower limb strings such that exposure of the flexible limbs to an unbalanced force that is small in comparison to the force supplied by the limbs onto the draw string in a resting position will not cause movement of the flexible limbs.

27. The archery bow improvement of claim 25 wherein said synchronizing means provides the flexible limbs with a resistance to movement due to exposure of the flexible limbs to an external force less than about fifty percent of the force applied by the flexible limbs onto the draw string in a resting position, said synchronizing means thereby providing equal flexing of limbs of flexibility that differ by less than about fifty percent, from a full drawn to a resting position, and linear movement of the nocking point along the centerline of the archery bow.

28. In an archery bow for launching an arrow, having an upper cam pulley means attached to a distal end of an upper flexible limb, for providing a let-off of force to a draw string in a full drawn position, and having a handle-riser with an upper and a lower end, the upper end being attached to a proximal end of the upper flexible limb, and having a lower flexible limb with a proximal end and a distal end, the proximal end of the lower flexible limb being attached to the lower end of the handle-riser, and the distal end of the flexible limb being attached to a lower cam pulley means, the lower cam pulley means providing additional let-off of force to the draw string in a full drawn position, and having an upper power string passing along the upper cam pulley means, and having a lower power string passing along said lower cam pulley means, and having an upper limb string attached to the distal end of the upper limb, and having a lower limb string attached to said distal end of said lower limb, and having a draw string with an upper end and a lower end, the upper end passing along the upper cam pulley means, and the lower end passing along the lower cam pulley means, the improvement comprising; a synchronizing pulley means attached to the handle-riser, said synchronizing pulley means comprising one or more axisymmetric synchronizing pulleys that provide a coupling between the upper flexible limb and the lower flexible limb via limb strings, said synchronizing pulley means providing that the upper power string, the lower power string, the upper limb string, and the lower limb string portions that are wrapped onto the synchronizing pulley means rotate the same number of degrees with respect to each other.

29. In a method for flexing two flexible limbs of a compound archery bow for launching an arrow wherein a nocking point of a draw string of a compound archery bow is drawn back from a resting position to a full drawn position, and the draw string is released to return from the full drawn position to the resting position, the draw string having an upper end and a lower end, the upper end passing along an upper limb cam pulley means attached to an upper flexible limb, and the lower end passing along a lower cam pulley means attached to a lower flexible limb, the upper and lower flexible limbs being attached to a handle-riser, the upper and lower cam pulley means providing for a let-off of draw force in a fully drawn position to the draw string, the drawing and release of the draw string producing a rotation and a counterrotation of the upper and lower flexible limb cam pulley means, the upper and lower flexible cam pulley means providing passage for a top and bottom power string, respectively, the upper and lower flexible limbs being attached to top and bottom limb strings respectively, the improvement in the method comprising;

A. the rotation of the upper cam pulley means during drawing of the draw string causing a take-up of a top power string having passage along the upper cam pulley means, the top power string having passage along a synchronizing pulley means attached to the handle-riser causing said synchronizing pulley means to rotate and provide pay-out of the top power string;

B. the rotation of the lower cam pulley means during drawing of the draw string causing take-up of a bottom power string having passage along the lower cam pulley means, the bottom power string also having passage along said synchronizing pulley means causing said synchronizing pulley means to rotate and provide pay-out of the bottom power string;

C. the rotation during drawing of the draw string of said synchronizing pulley means having passage for the top and the bottom limb strings such that they are paid out and taken up equal amounts causing the upper and lower flexible limbs to flex equally to the same amount of deflection;

D. the counterrotation of said synchronizing pulley means upon release of the draw string providing equal pay-out for the top and the bottom limb strings allowing the upper and lower flexible limbs to flex equally to the same amount of deflection;

E. the counterrotation of said synchronizing pulley means upon release of the draw string providing take-up of the upper and lower power strings, and take-up of the draw string.

30. The method of claim 29 wherein said synchronizing pulley means couples the deflection of the upper and lower flexible limbs via the limb strings such that variations in flexibility between the upper and lower flexible limbs of less than about fifty percent results in equal deflection of the flexible limbs from a resting position to a full drawn position and from a full drawn position to a resting position.

31. The method of claim 29 wherein said synchronizing pulley means couples the deflection of the flexible limbs via the limb strings to the same amount of deflection to produce a linear movement of the nocking point of the draw string and launches an arrow with greater accuracy than a compound bow without a synchronizing pulley mechanism.

* * * * *